US009748662B2

(12) United States Patent
Toyao

(10) Patent No.: US 9,748,662 B2
(45) Date of Patent: Aug. 29, 2017

(54) ANTENNA AND WIRELESS COMMUNICATION DEVICE

(71) Applicant: NEC CORPORATION, Tokyo (JP)

(72) Inventor: Hiroshi Toyao, Tokyo (JP)

(73) Assignee: NEC CORPORATION, Tokyo (JP)

( * ) Notice: Subject to any disclaimer, the term of this patent is extended or adjusted under 35 U.S.C. 154(b) by 38 days.

(21) Appl. No.: 14/437,253

(22) PCT Filed: Nov. 12, 2013

(86) PCT No.: PCT/JP2013/080586

§ 371 (c)(1),
(2) Date: Apr. 21, 2015

(87) PCT Pub. No.: WO2014/073703

PCT Pub. Date: May 15, 2014

(65) Prior Publication Data

US 2015/0288071 A1 Oct. 8, 2015

(30) Foreign Application Priority Data

Nov. 12, 2012 (JP) ..... 2012-248169

(51) Int. Cl.
*H01Q 1/24* (2006.01)
*H01Q 15/00* (2006.01)
(Continued)

(52) U.S. Cl.
CPC ..... *H01Q 15/0086* (2013.01); *H01Q 1/48* (2013.01); *H01Q 9/265* (2013.01); *H01Q 21/24* (2013.01); *H01Q 21/28* (2013.01); *H01Q 21/30* (2013.01)

(58) Field of Classification Search
CPC ..... H01Q 9/265; H01Q 21/28; H01Q 21/30; H01Q 1/48
(Continued)

(56) References Cited

U.S. PATENT DOCUMENTS 6,323,810 B1 * 11/2001 Poilasne ..... H01Q 1/38 343/700 MS
2005/0168384 A1 * 8/2005 Wang ..... H01Q 1/22 343/700 MS
2011/0193762 A1 * 8/2011 Choi ..... H01Q 1/243 343/848

FOREIGN PATENT DOCUMENTS

CN 1391308 A 1/2003
CN 102349196 A 2/2012
(Continued)

OTHER PUBLICATIONS

Kamil Boratay Alici et al., "Electrically small split ring resonator antennas", Journal of Applied Physics, Apr. 20, 2007, pp. 083104-1-083104-4, vol. 101.

(Continued)

*Primary Examiner* — Dieu H Duong
(74) *Attorney, Agent, or Firm* — Sughrue Mion, PLLC

(57) ABSTRACT

A small antenna operating at a plurality of frequency bands includes a first conductor plane in which a first split ring resonator and a second split ring resonator that have different resonant frequencies are formed and a feed line including a first branch line, a second branch line and a branch portion. Each of the split ring resonators includes a conductor region along an opening edge of an opening formed in the first conductor plane and a split portion cutting through a portion of the conductor region. One end of the first branch line is connected to the first split ring resonator and the other end extends to the branch portion across the conductor region; one end of the second branch line is connected to the second split ring resonator and the other end extends to the branch portion across the conductor region.

10 Claims, 20 Drawing Sheets

(51) Int. Cl.

| | |
|---|---|
| ***H01Q 21/30*** | (2006.01) |
| ***H01Q 1/48*** | (2006.01) |
| ***H01Q 9/26*** | (2006.01) |
| ***H01Q 21/28*** | (2006.01) |
| ***H01Q 21/24*** | (2006.01) |

(58) Field of Classification Search
USPC ..... 343/700 MS, 702
See application file for complete search history.

(56) References Cited

FOREIGN PATENT DOCUMENTS

| | | | |
|---|---|---|---|
| CN | 102456945 | A | 5/2012 |
| CN | 202282452 | U | 6/2012 |
| CN | 102664662 | A | 9/2012 |
| JP | 6-204734 | A | 7/1994 |
| JP | 2003-114265 | A | 4/2003 |
| JP | 2007-235832 | A | 9/2007 |
| JP | 2007-306585 | A | 11/2007 |
| JP | 2010-103609 | A | 5/2010 |
| JP | 2011-041100 | A | 2/2011 |
| JP | 2011-41100 | A | 2/2011 |
| JP | 2011-254482 | A | 12/2011 |
| JP | 2012-85262 | A | 4/2012 |
| WO | 2008/111460 | A1 | 9/2008 |
| WO | 2011/140653 | A1 | 11/2011 |
| WO | 2012/107976 | A1 | 8/2012 |

OTHER PUBLICATIONS

Mikko Karkkainen et al., "Patch Antenna with Stacked Split-Ring Resonators as an Artificial Magneto-Dielectric Substrate", Microwave and Optical Technology Letters, Sep. 20, 2005, pp. 554-556, vol. 46, No. 6.

International Search Report for PCT/JP2013/080586 dated Feb. 18, 2014.

Communication dated Jun. 21, 2016 from the State Intellectual Property Office of the P.R.C. in counterpart application No. 201380059096.2.

* cited by examiner

ANTENNA AND WIRELESS COMMUNICATION DEVICE

CROSS REFERENCE TO RELATED APPLICATIONS

This application is a National Stage of International Application No. PCT/JP2013/080586 filed Nov. 12, 2013, claiming priority based on Japanese Patent Application No. 2012-248169 filed Nov. 12, 2012, the contents of all of which are incorporated herein by reference in their entirety.

TECHNICAL FIELD

The present invention relates to an antenna including a split ring resonator that operates in a plurality of frequency bands and a wireless communication device using the antenna. This application is based upon and claims the benefit of priority from Japanese Patent Application No. 2012-248169, filed on Nov. 12, 2012, the entire contents of which are incorporated herein.

BACKGROUND ART

Various techniques have been developed for antennas and structures used in wireless communication devices. For example, PTL 1 discloses an antenna device whose resonant frequency is tunable with a high degree of precision. PTL 2 (which is equivalent to WO98/44590) discloses a feed network for antenna. PTL 3 discloses an electromagnetic wave propagation medium that has broadband phase response. PTL 4 discloses an antenna device using a microwave resonator device. PTL 5 (which is equivalent to WO2006/023195) discloses metamaterials, including lenses having negative refractive indices in a wide band, diffractive optical devices, and gradient index optical devices. PTL 6 discloses a microwave transmission line. NPL 1 and NPL 2 disclose split ring resonator antennas.

Metamaterials in which a conductor pattern having a certain structure is periodically arranged to artificially control propagation characteristics of electromagnetic waves propagating through the structure have been developed in recent years. Among known basic components of the metamaterials are resonators that use a C-shaped split ring which is a ring conductor one circumferential portion of which is cut. The split ring resonators can interact with magnetic fields to control an effective magnetic permeability.

On the other hand, there is demand for reduction of the whole size of electronic devices that have communication functionality (for example wireless communication devices) and accordingly antennas need to be reduced in size. Therefore, the use of split ring resonators to reduce the size of antennas has been proposed. For example, NPL 1 discloses a technique in which a split ring resonator is disposed near a monopole antenna to increase the effective magnetic permeability and reduce the size of the monopole antenna. NPL 2 discloses a technique in which split ring resonators are periodically disposed in a region between a patch and a ground plane of a patch antenna to increase the effective magnetic permeability and reduce the size of the patch antenna.

In relation to the techniques described above, PTL 1 discloses an antenna device in which a slot is formed in a conductor plate provided on a surface of a dielectric substrate and a stub is formed on the other surface of the dielectric substrate through a via in such a manner that the stub extends across the slot, thereby enabling precise tuning of resonant frequency.

CITATION LIST

Patent Literature

[PTL 1] Japanese Laid-open Patent Publication No. 2012-85262

[PTL 2] Japanese Laid-open Patent Publication No. 2007-306585

[PTL 3] Japanese Laid-open Patent Publication No. 2010-103609

[PTL 4] Japanese Laid-open Patent Publication No. 2011-41100

[PTL 5] Japanese Laid-open Patent Publication No. 2011-254482

[PTL 6] WO2008/111460A1

Non Patent Literature

[NPL 1] "Electrically Small Split Ring Resonator Antennas", Journal of Applied Physics, 101, 083104 (2007)

[NPL 2] "Patch Antenna with Stacked Split-Ring Resonators as an Artificial Magneto-Dielectric Substrate", Microwave and Optical Technology Letters, Vol. 46, No. 6, Sep. 20, 2005

SUMMARY OF INVENTION

Technical Problem

The antennas using split ring resonators disclosed in NPL 1 and NPL 2 operate in only one frequency band and therefore it is difficult for these antennas to conform to wireless communication standards that use multiple frequency bands as in wireless LANs. Furthermore, electronic devices that equipped with GPS and wireless LAN functionality need to operate on a plurality of frequency bands. However, conventional techniques are difficult to conform to a plurality of wireless communication standards.

The present invention has been made in order to solve the problem described above and an object of the present invention is to provide an antenna configured by combining a plurality of split ring resonators so as to operate in a plurality of frequency bands and a wireless communication device using the antenna.

Solution to Problem

A first mode of the present invention is an antenna including a first conductor plane in which a first split ring resonator and a second split ring resonator that have different resonant frequencies are formed and a feed line including a first branch line, a second branch line and a branch portion. The first split ring resonator includes a first conductor region along an opening edge of a first opening formed in the first conductor plane and a first split portion cutting through a portion of the first conductor region. The second split ring resonator includes a second conductor region along an opening edge of a second opening formed in the first conductor plane and a second split portion cutting through a portion of the second conductor region. One end of the first branch line is connected to the first split ring resonator and the other end extends to the branch portion across the first conductor region; one end of the second branch line is connected to the second split ring resonator and the other end extends to the branch portion across the second conductor region.

A second mode of the present invention is a wireless communication device that uses electromagnetic waves including two or more frequencies to transmit and receive wireless signals. The wireless communication device includes an antenna having the configuration described above.

Advantageous Effects of Invention

The present invention provides a small antenna in which a plurality of split ring resonators having different resonant frequencies are compactly arranged. The use of the antenna in a wireless communication device enables transmission and reception of wireless signals in conformity with a plurality of communication standards without increasing the whole size of the wireless communication device.

DESCRIPTION OF EMBODIMENTS

Figure 1:
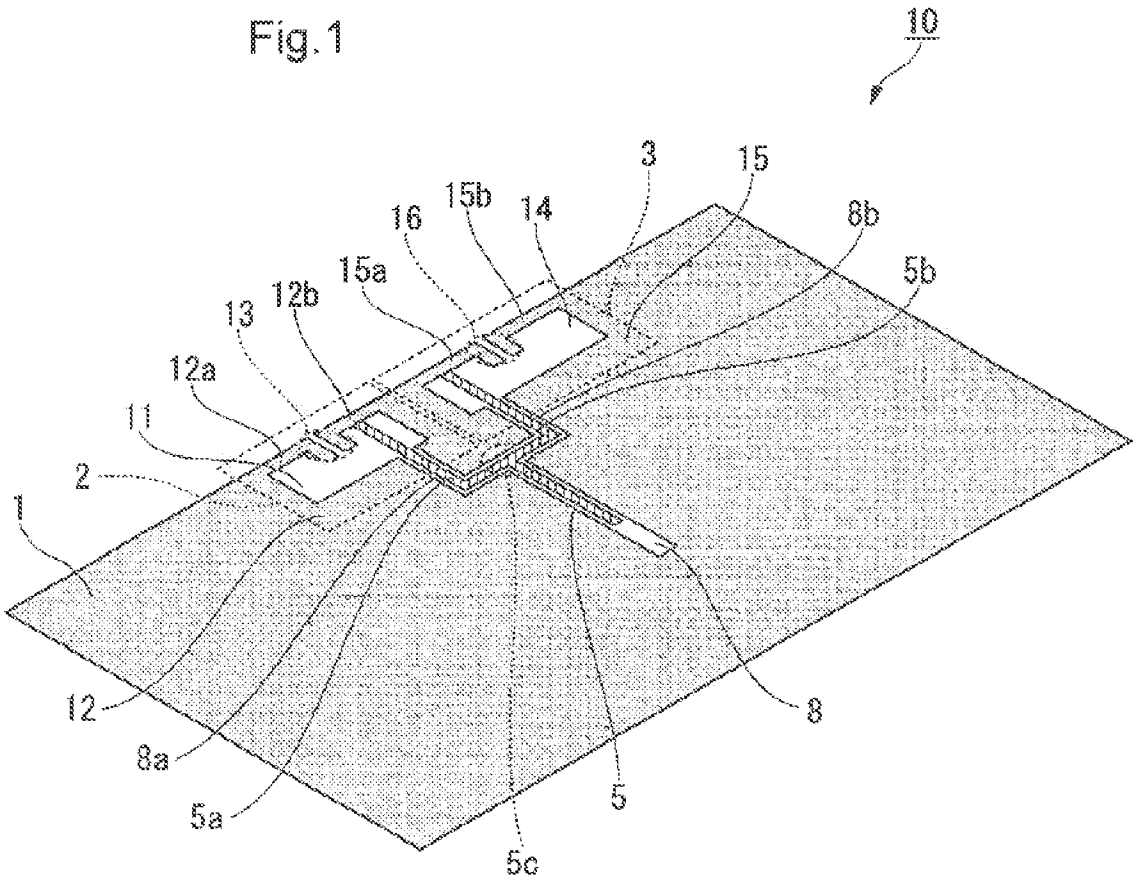
FIG. 1 is a perspective view of an antenna according to a first exemplary embodiment of the present invention.

Antennas and wireless communication devices according to the present invention will be described in detail with exemplary embodiments with reference to the accompanying drawings. Note that the same or like components are given the same or like reference numerals throughout the drawings and repeated description thereof will be omitted as appropriate.

First Exemplary Embodiment

FIG. 1 is a perspective view of an antenna 10 according to a first exemplary embodiment of the present invention. The antenna 10 includes a first conductor plane 1 including a first split ring resonator 2 and a second sprit ring resonator 3, and a feed line 5. The feed line 5 includes a first branch line 5*a*, a second branch line 5*b* and a branch portion 5*c* that electrically interconnects the first branch line 5*a* and the second branch line 5*b*.

The first split ring resonator 2 includes a first conductor region 12 along an opening edge of a first opening 11 formed in the first conductor plane 1 and a first split portion 13 formed by cutting a portion of the first conductor region 12. The second split ring resonator 3 includes a second conductor region 15 along an opening edge of a second opening 14 formed in the first conductor plane 1 and a second split portion 16 formed by cutting a portion of the second conductor region 15. Specifically, the first split ring resonator 2 is a particular conductor region that occupies a portion of the first conductor plane 1 and is a C-shaped conductor region made up of the first conductor region 12 which is a frame-like region around the opening edge of the first opening 11 and the first split portion 13 that cuts through a portion of the first conductor region 12. However, the first split ring resonator 2 does not have a defined border with the other region of the first conductor plane 1. The second split ring resonator 3 is a particular conductor region that occupies a portion of the first conductor plane 1 and is a C-shaped conductor region made up of the second conductor region 15 which is a frame-like region around the opening edge of the second opening 14 and the second split portion 16 that cuts through a portion of the second conductor region 15. In order to set desired resonance characteristics in the antenna 10, the first opening 11 and the second opening 14 are preferably formed close to the edge of the first conductor plane 1 as illustrated in FIG. 1, but not so limited.

The first conductor plane 1 is rectangular shaped in plan view and the first split portion 13 and the second split portion 16 are formed on the same side of the first conductor plane 1, but not so limited. It should be that at least a portion of the periphery of the first conductor plane 1 form a linear side and the first split portion 13 and the second split portion 16 be formed on the same side.

As illustrated in FIG. 1, the first conductor region 12 includes a first left arm portion 12*a* and a first right arm portion 12*b* with the first split portion 13 between the two. The second conductor region 15 includes a second left arm portion 15*a* and a second right arm portion 15*b* with the second split portion 16 between the two. The first left arm portion 12*a* and the first right arm portion 12*b* may be formed into an L-shape inside the first conductor plane 1. This is an arrangement for adjusting capacitance formed by arranging the first left arm portion 12*a* and the first right arm portion 12*b* in parallel across the first split portion 13 to a desired value, but the arrangement is not limited to this. The configuration in FIG. 1 may be modified depending on the capacitance value as appropriate. The same applies to the second left arm portion 15*a* and the second right arm portion 15*b*.

One end of the first branch line 5*a* of the feed line 5 is connected to the first split ring resonator 2 and the other end extends to the branch line 5*c* across the first conductor region 12. One end of the second branch line 5*b* of the feed line 5 is connected to the second split ring resonator 3 and the other end extends to the branch portion 5*c* across the second conductor region 15.

The first conductor plane 1 includes a clearance 8 which communicates with the first opening 11 and the second opening 14. In particular, the clearance 8 includes a first branch clearance 8*a* that communicates with the first opening 11 and a second branch clearance 8*b* that communicates with the second opening 14. The branch clearances 8*a* and 8*b* are formed so that they extend, join together and then extend in one direction. The feed line 5 is formed in the same plane as the components given above in the first conductor plane 1 and extends inside the clearance 8 while keeping a predetermined distance to the first conductor plane 1 at both sides. Specifically, one end of the first branch line 5*a* connects to the first right arm portion 12*b* provided closer to the second split ring resonator 3 with respect to the first split portion 13. The other end passes through the first opening 11, extends inside the first clearance 8*a* across the first conductor region 12 at the opposite side, and connects to the branch portion 5*c*. One end of the second branch line 5*b* connects to the second left arm portion 15*a* provided closer to the first split ring resonator 2 with respect to the second split portion 16. The other end passes through the second opening 14, extends inside the second clearance 8*b* across the second conductor region 15 at the opposite side, and connects to the branch portion 5*c*.

The first branch line 5*a* and the second branch line 5*b* of the feed line 5 extend and connect to the branch portion 5*c* and the feed line 5 extends inside the clearance 8 in one direction. Then, the end of the feed line 5 connects to a radio frequency circuit (RF circuit, not depicted). Note that "the first branch line 5*a* (or the second branch line 5*b*) extends across the first conductor region 12 (or the second conductor region 15)" means that the first branch line 5*a* (or the second branch line 5*b*) extends inside the first branch clearance 8*a* (or the second branch clearance 8*b*) which is a portion where the conductor in the first conductor region 12 (or the second conductor region 15) is partially missing.

The feed line 5 electrically couples to the first conductor plane 1 disposed at both sides of the feed line 5 with the clearance 8 between them to form a transmission line. The characteristic impedance of the transmission line can be set by adjusting the line width of the first branch line 5*a* and the second branch line 5*b* of the feed line 5 or the distance between each of the first branch line 5*a* and the second branch line 5*b* and the first conductor plane 1 as appropriate. Accordingly, the characteristic impedance of the transmission line can be matched to the impedance of the RF circuit to provide a signal from the RF circuit to the antenna without reflection. However, whether the characteristic impedance of the transmission line matches to the impedance of the RF circuit or not does not affect the operation of this exemplary embodiment.

In the antenna 10, the first branch line 5*a* connects to the first right arm portion 12*b* of the first split ring resonator 2 whereas the second branch line 5*b* connects to the second left arm portion 15*a* of the second split ring resonator 3. This enables good impedance matching to the split ring resonators 2 and 3 at a resonant frequency. Furthermore, in the antenna 10, impedance matching between the first branch line 5*a* and the first split ring resonator 2 can be adjusted by adjusting the position of connection between the first branch line 5*a* and the first right arm portion 12*b* without inserting an impedance matching circuit. Moreover, in the antenna 10, impedance matching between the second branch line 5*b* and the second split ring resonator 3 can be adjusted by adjusting the position of connection between the second branch line 5*b* and the second left arm portion 15*a* without inserting an impedance matching circuit.

Typically, the first conductor plane 1 and the feed line 5 are made of copper foil in any of the layer in a multilayer printed circuit board and a dielectric substrate (not depicted) supports the first conductor plane 1 and the feed line 5. However, the antenna 10 according to the first exemplary embodiment does not necessarily need to be formed in a multilayer printed circuit board. For example, the antenna 10 may be formed on a metal sheet. Furthermore, the first conductor plane 1 and the feed line 5 may be made of any conductive material other than copper foil and may be made of the same material or different materials.

A specific operation of the antenna 10 according to the first exemplary embodiment will be described next. The resonant frequency of the first split ring resonator 2 in the antenna 10 is denoted by f1 and the resonant frequency of the second split ring resonator 3 is denoted by f2. It is assumed that the characteristic impedance of the transmission line made up of the feed line 5, the clearance 8 and the first conductor plane 1 has been appropriately adjusted so that reflection of a radio frequency signal (RF signal) does not occur.

First, the RF circuit (not depicted) as an RF source (or a feeding point) connected to the feed line 5 provides an RF signal of the frequency f1 to the feed line 5. The feed line 5 propagates the RF signal of the frequency f1 input from the RF circuit without reflection, thereby providing radio frequency power (RF power) to the first split ring resonator 2. Note that impedance matching for the frequency f1 is not done in the transmission line made up of the second split ring resonator 3 and the branch line 5*b* and therefore the feed line 5 does not transmit the RF signal of the frequency f1 to the second split ring resonator 3.

The first split ring resonator 2 into which the RF signal of the frequency f1 has been input functions as an LC series resonance circuit made up of an inductance formed by the first conductor region 12 along the opening edge of the first opening 11 and a capacitance formed by the first left arm portion 12*a* and the first right arm portion 12*b* disposed in parallel across the first split portion 13 to resonate the input RF signal. Then the antenna 10 emits an electromagnetic signal of the frequency f1 into the air on the basis of resonance that occurs in the first split ring resonator 2.

An operation by the RF circuit to transmit an RF signal of the frequency f2 to the feed line 5 will be described next. The feed line 5 propagates an RF signal of the frequency f2 input from the RF circuit without reflection, thereby providing RF power to the second split ring resonator 3. Note that impedance matching for the frequency f2 is not done in the transmission line made up of the first split ring resonator 2 and the branch line 5*a* and therefore the feed line 5 does not transmit the RF signal of the frequency f2 to the first split ring resonator 2.

The second split ring resonator 3 into which the RF signal of the frequency f2 has been input functions as an LC series resonance circuit made up of an inductance formed by the second conductor region 15 along the opening edge of the second opening 14 and a capacitance formed by the second left arm portion 15*a* and the second right arm portion 15*b* disposed in parallel across the second split portion 16 to resonate the input RF signal. Then the antenna 10 emits an electromagnetic signal of the frequency f2 into the air on the basis of resonance that occurs in the second split ring resonator 3.

Figure 15:
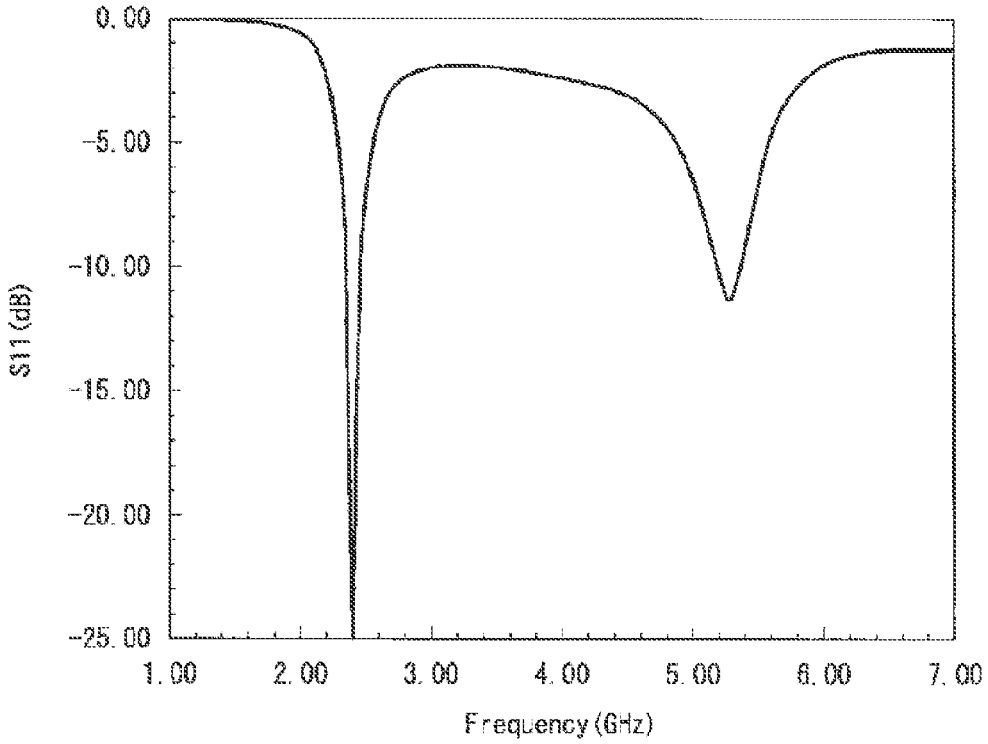
FIG. 15 is a graph illustrating a result of an electromagnetic field simulation of the antenna according to the first exemplary embodiment.

FIG. 15 is a graph illustrating a result of an electromagnetic field simulation of the antenna 10 according to the first exemplary embodiment. The result of the electromagnetic field simulation in FIG. 15 represents the amount of reflected power S11 (dB) in the antenna 10 of the first exemplary embodiment viewed from the feed line 5. Smaller amount of reflected power S11 represent better impedance matching between the feed line 5 and the split ring resonators 2, 3 and better power feeding from the feed line 5 to the split ring resonators 2, 3. As can be seen from FIG. 15, the amount of reflected power S11 decreases in both of 2.4 GHz and 5 GHz bands used in wireless LANs, which fact shows that the antenna 10 of the first exemplary embodiment operates well as a multiband antenna.

While the RF circuit outputs the RF signals of the frequencies f1 and f2 in different periods in the foregoing description, the RF circuit may concurrently outputs the RF signals of the frequencies f1 and f2. Furthermore, while the antenna 10 reflects electromagnetic waves as the sender of radio signals in the foregoing description, the antenna 10 is not so limited. The antenna 10 can receive electromagnetic waves as the receiver of radio signals. Specifically, the antenna can receive an electromagnetic wave (for example an RF signal) of the frequency f1 or f2 that has transmitted from an external device and propagated through the air and can send the RF signal to the RF circuit (or a receiving circuit). In this case, the antenna 10 performs the operation procedure that is the reverse of the procedure described above.

In the split ring resonators 2, 3, the openings 11, 14 can be enlarged to elongate the ring-like current path, thereby increasing the inductance to decrease the resonant frequency. Furthermore, reducing the distance between the conductors arranged in parallel across the split portion 13 (or the split portion 16) in the antenna 10, i.e. the first left arm portion 12*a* and the first right arm portion 12*b* (or the second left arm portion 15*a* and the second right arm portion 15*b*), can increase the capacitance to decrease the resonant frequency. Alternatively, increasing the width of the conductors arranged in parallel across the split portion 13, 16 in the antenna 10 can increase the capacitance to decrease the resonant frequency.

Especially, the method that increases the capacitance formed across the split portion 13, 16 can decrease the resonant frequency without increasing the whole size of the antenna 10 and therefore can reduce the antenna 10 in size in comparison with the wavelengths of electromagnetic waves. Furthermore, settings can be made to allow the split ring resonators 2 and 3 to have different resonance frequencies, thereby enabling the antenna 10 to function as a multiband antenna. In this way, in the antenna 10 according to the first exemplary embodiment, the split ring resonators 2 and 3 can be reduced in size in comparison with the wavelengths of electromagnetic waves and an impedance matching circuit does not need to be included in order to achieve impedance matching to a particular frequency. Accordingly, the antenna 10 according to the first exemplary embodiment is smaller than an antenna in which a plurality of combinations of one split ring resonator, one transmission line and one RF circuit are provided, and yet is capable of operating in a plurality of frequency bands. Consequently, provision of at least one antenna 10 according to the first exemplary embodiment in a wireless communication device can reduce the whole size of the wireless communication device.

Figure 2:
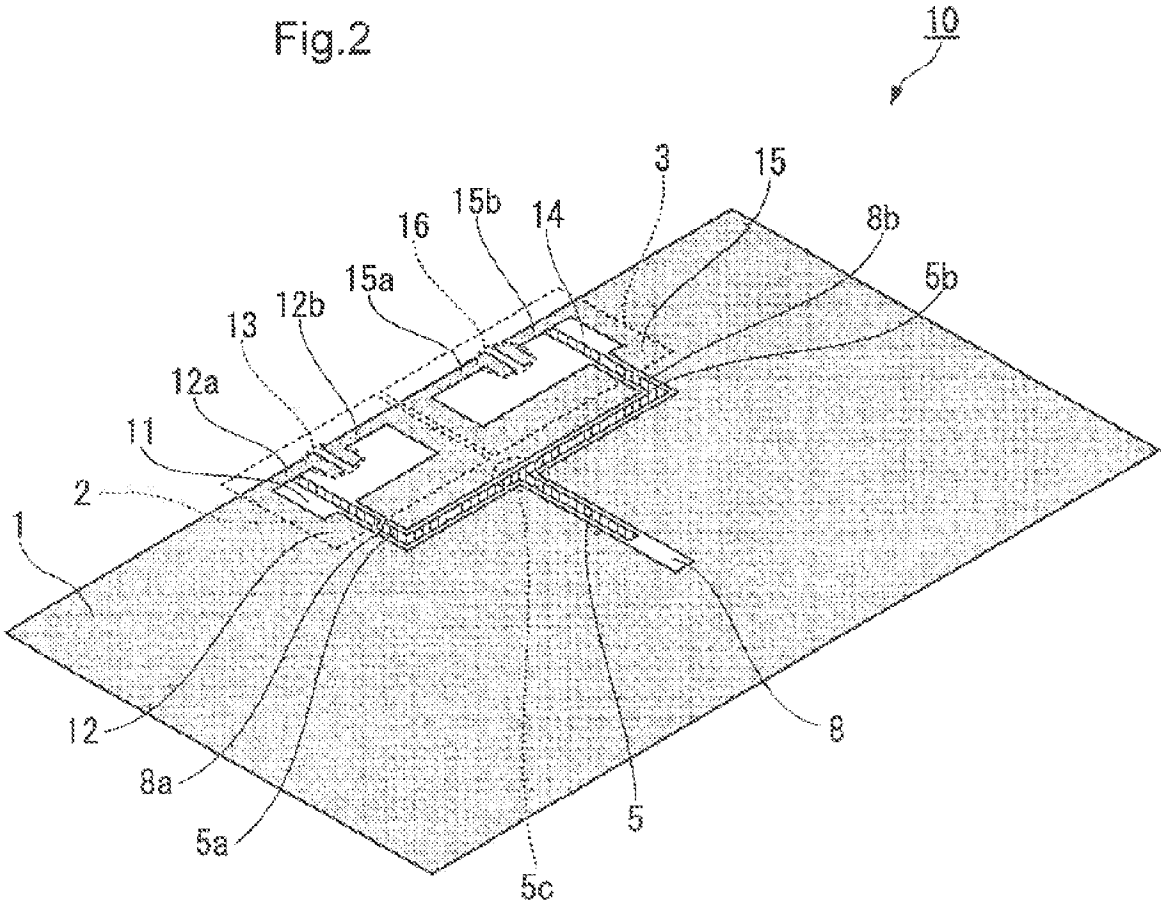
FIG. 2 is a perspective view of a first variation of the antenna of the first exemplary embodiment.

The structure of the antenna 10 according to the first exemplary embodiment is not limited to the structure illustrated in FIG. 1; the antenna 10 may be modified into any of the structures illustrated in FIGS. 2 to 5. For example, connections between the branch lines 5*a*, 5*b* and the split ring resonators 2, 3 are not limited to the connections illustrated in FIG. 1 in the antenna 10. FIG. 2 is a perspective view of a first variation of the antenna 10. As illustrated in FIG. 2, a first branch line 5*a* may be connected to a first left arm portion 12*a* located farther from a second split ring resonator 3 with respect to a first split portion 13 of a first split ring resonator 2. A second branch line 5*b* may be connected to a second right arm portion 15*b* located farther from the first split ring resonator 2 with respect to a second split portion 16 of the second split ring resonator 3. In the structure illustrated in FIG. 2, good impedance matching can be achieved at the resonant frequency of the split ring resonators 2, 3.

Figure 16:
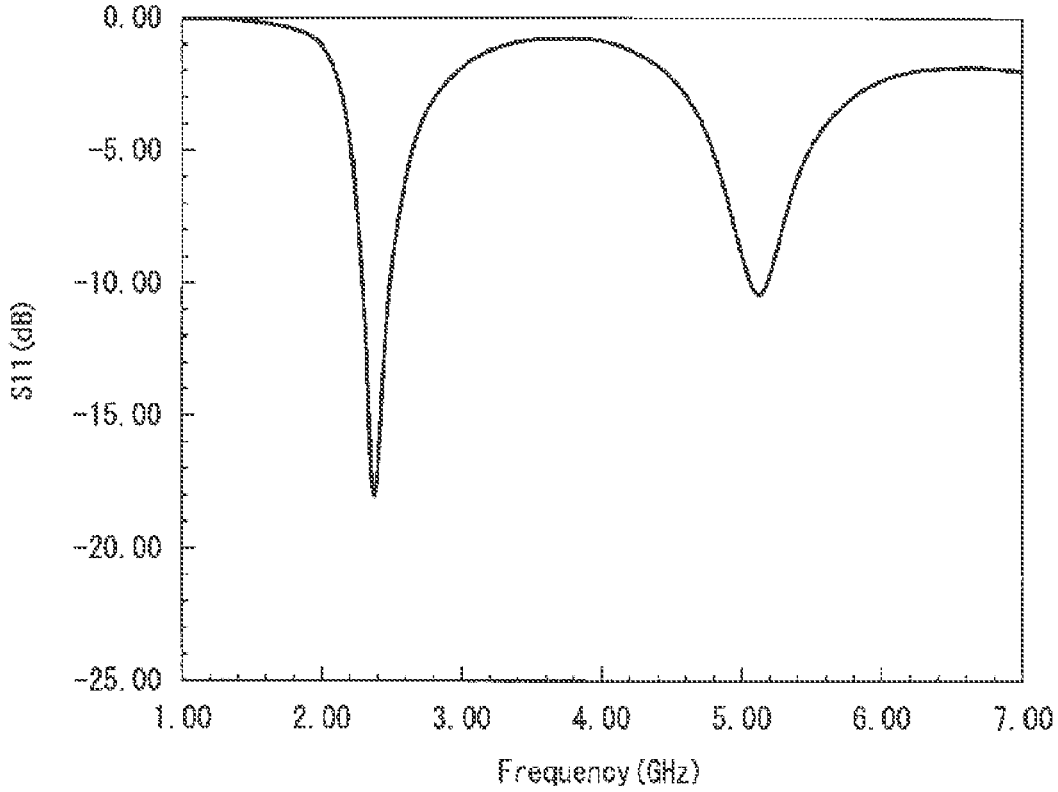
FIG. 16 is a graph illustrating a result of electromagnetic field simulation of the antenna according to the first variation of the first exemplary embodiment.

FIG. 16 is a graph illustrating a result of an electromagnetic field simulation of the antenna 10 according to the first variation of the first exemplary embodiment. The result of the electromagnetic field simulation in FIG. 16 represents the amount of reflected power S11 (dB) in the antenna 10 in FIG. 2 viewed from the feed line 5. As can be seen from FIG. 16, the amount of reflected power S11 decreases in both of 2.4 GHz and 5 GHz bands used in wireless LANs, which fact shows that the antenna 10 in FIG. 2 operates well as a multiband antenna.

By adjusting the position of connection between the first branch line 5*a* and the first left arm portion 12*a* in the antenna 10 in FIG. 2, impedance matching between the first branch line 5*a* and the first split ring resonator 2 can be adjusted without installing an impedance matching circuit. Furthermore, by adjusting the position of connection between the second branch line 5*b* and the second right arm portion 15*b*, impedance matching between the second branch line 5*b* and the second split ring resonator 3 can be adjusted without installing an impedance matching circuit.

Note that the mode of connections between the branch lines 5*a*, 5*b* and the split ring resonators 2, 3 is not limited to the connection modes illustrated in FIGS. 1 and 2 and does not affect the effects of this exemplary embodiment. For example, the first branch line 5*a* may be connected to the first right arm portion 12*b* and the second branch line 5*b* may be connected to the second right arm portion 15*b*. Alternatively, the first branch line 5*a* may be connected to the first left arm portion 12*a* and the second branch line 5*b* may be connected to the second left arm portion 15*a*. While the modes of connections between the branch line 5 and the split ring resonators 2, 3 in the antenna 10 illustrated in FIGS. 1 and 2 are preferable, other connection modes may be employed.

While components or wiring lines are not provided in the region of the first conductor plane 1 in FIGS. 1 and 2, LSI components, IC components and wiring lines may be provided in the region of the first conductor plane 1. For example, the RF circuit connected to the feed line 5 may be provided in a region in the first conductor pane 1. However, current flowing through the antenna 10 according to the first exemplary embodiment flows not only around the split ring resonators 2, 3 but also through the entire first conductor plane 1. Accordingly, if there is an opening greater than the openings 11, 14, current flowing around the opening could provide another antenna function and generate electromagnetic radiation not expected by the designer. Therefore, the size of an opening for providing an additional component and wiring line in the first conductor plane 1 of the antenna 10 of the first exemplary embodiment are preferably smaller than the openings 11, 14. However, provision of an opening for providing a component or a wiring line in the first conductor plane 1 does not affect the operation of the antenna 10 of the first exemplary embodiment.

Figure 3:
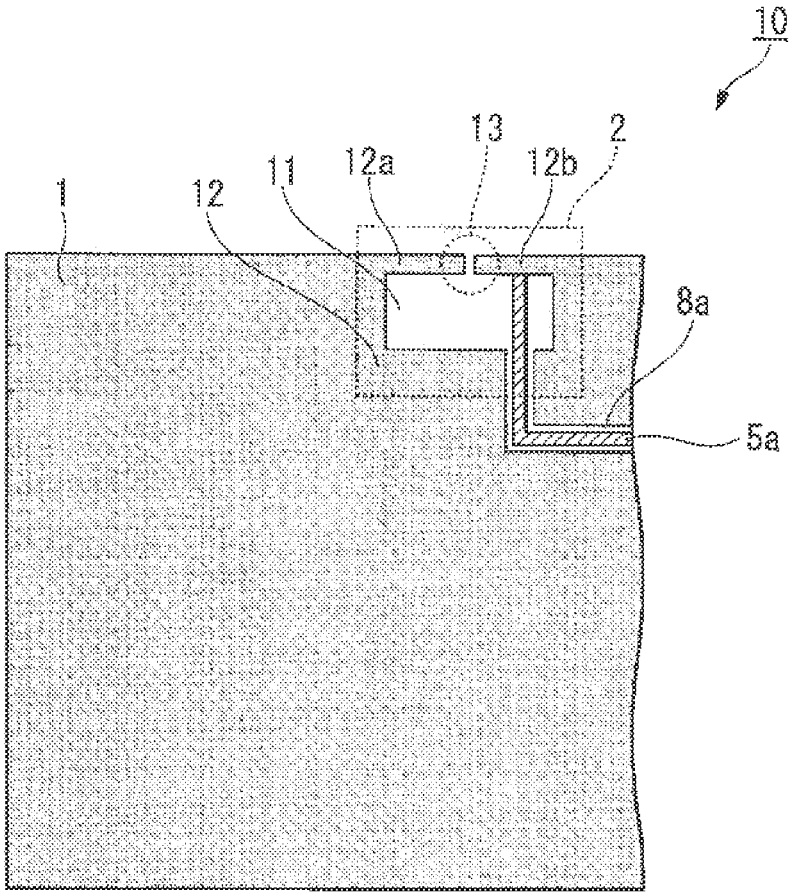
FIG. 3 is a plan view of a second variation of the antenna of the first exemplary embodiment.

FIG. 3 is a plan view illustrating a second variation of the antenna 10 of the first exemplary embodiment. In FIGS. 1 and 2, in order to provide a certain length of the left arm portions 12*a*, 15*a* and the right arm portions 12*b*, 15*b* arranged in parallel across the split portions 13, 16, the left arm portions 12*a*, 15*a* and the right arm portions 12*b*, 15*b* are turned at right angles and formed into an L shape extending insides the split ring resonators 2, 3. However, the left arm portions 12*a*, 15*a* and the right arm portions 12*b*, 15*b* do not need to be formed into an L shape. For example, if the capacitance in an antenna 10 can be chosen to be small, the first left arm portion 12*a* and the first right arm portion 12*b* may be formed without turning as illustrated in FIG. 3.

Figure 4:
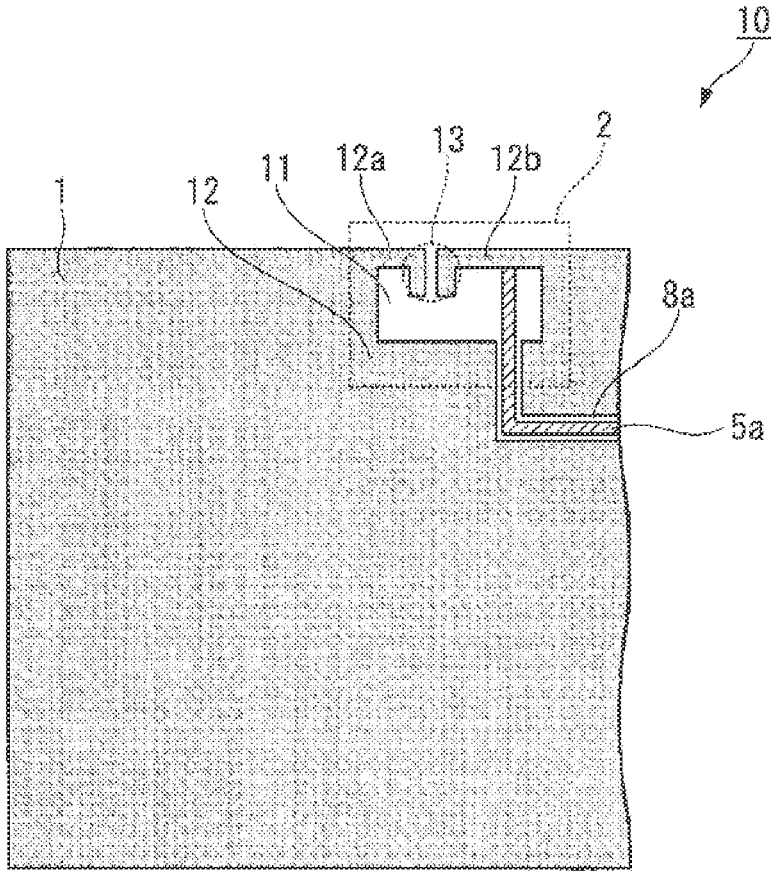
FIG. 4 is a plan view of a third variation of the antenna of the first exemplary embodiment.

FIG. 4 is a plan view illustrating a third variation of the antenna 10 of the first exemplary embodiment. While the split portions 13, 16 are formed in the center of the length of the openings 11, 14 in FIGS. 1 and 2, the split portions 13, 16 are not so limited. As illustrated in FIG. 4, the split portion 13 may be formed in a position outside the central part of the length of the opening 11 (for example at the left-hand side in plan view). Alternatively, the first split portion 13 may be formed in two locations on the periphery of the first conductor region 12.

Figure 5:
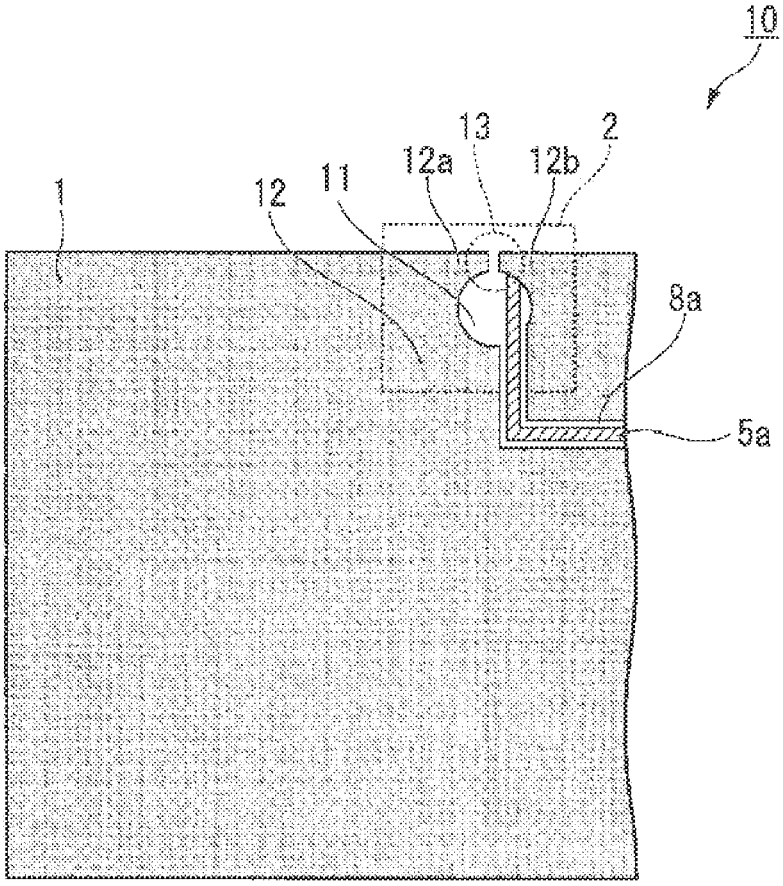
FIG. 5 is a plan view of a fourth variation of the antenna of the first exemplary embodiment.

FIG. 5 is a plan view illustrating a fourth variation of the antenna of the first exemplary embodiment. While the openings 11, 14 in FIGS. 1 and 2 are rectangular shaped, the shape of the openings 11, 14 are not limited to rectangles. As illustrated in FIG. 5, the first opening 11 may be shaped into a circle or other shape. While the second opening 14 of the second split ring resonator 3 is larger than the first opening 11 of the first split ring resonator 2 in FIGS. 1 and 2, they are not so limited. The first opening 11 of the first split ring resonator 2 may be larger than the second opening 14 of the second split ring resonator 3.

Second Exemplary Embodiment

Figure 6:
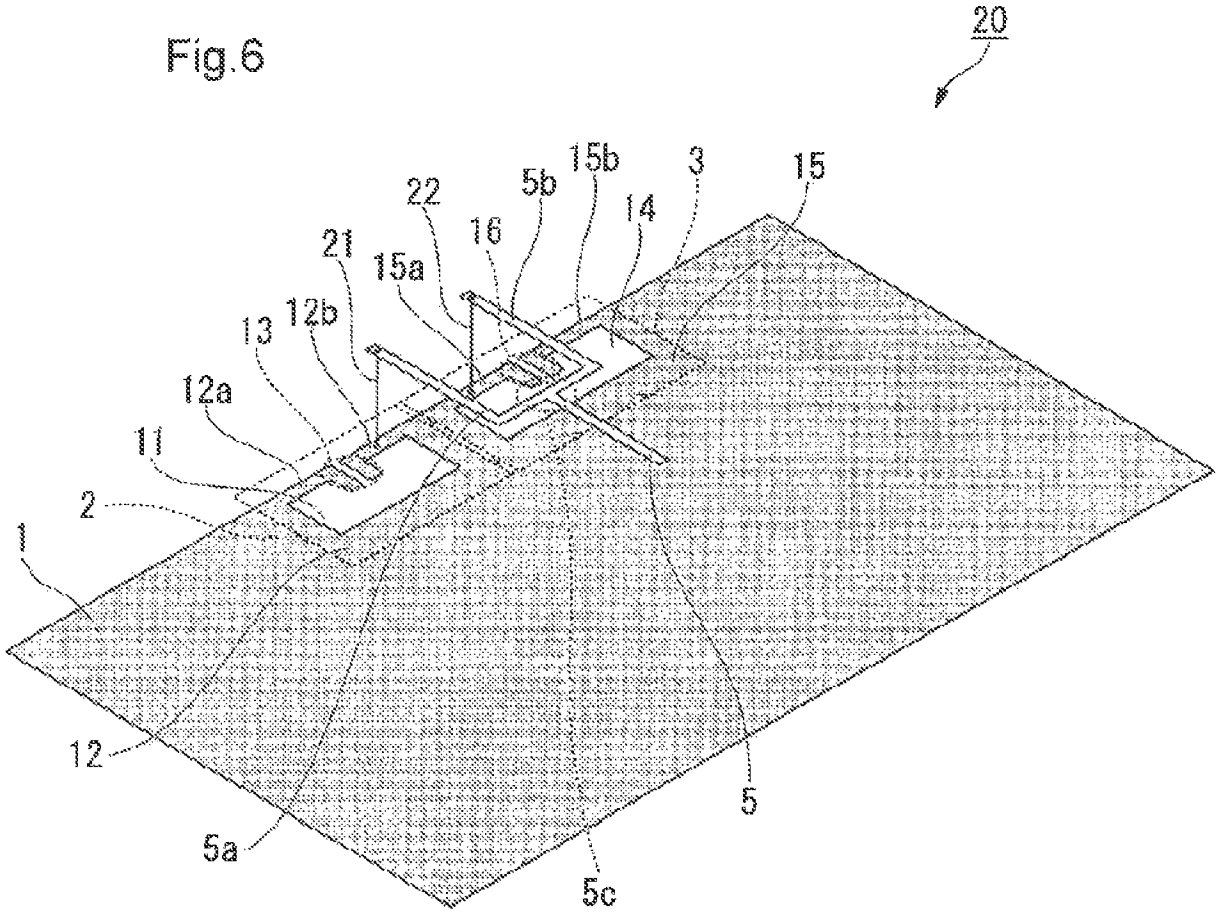
FIG. 6 is a perspective view of an antenna according to a second exemplary embodiment of the present invention.

FIG. 6 is a perspective view of an antenna 20 according to a second exemplary embodiment of the present invention. In the antenna 20 in FIG. 6, the same components as those of the antenna 10 in FIG. 1 are given the same reference numerals and the description thereof will be simplified. The antenna 20 has a configuration similar to that of the antenna 10 and differences between the two will be described. In the antenna 20, a feed line 5 is disposed in a plane that is different from a first conductor plane 1 and faces the first conductor plane 1. One end of a first branch line 5*a* of the feed line 5 is connected to a first right arm portion 12*b* of a first split ring resonator 2 through a first feed conductor via 21. The other end extends in the plane facing the first conductor plane 1 across a first opening 11 and a first conductor region 12 and connects to a branch portion 5*c*. One end of the second branch line 5*b* is connected to a second left arm portion 15*a* of a second split ring resonator 3 through a second feed conductor via 22. The other end extends in the plane facing the first conductor plane 1 across a second opening 14 and a second conductor region 15 and connects to a branch portion 5*c*. The feed line 5 extends from the branch portion 5*c* at which the first branch line 5*a* and the second branch line 5*b* are interconnected in one direction and is connected to an RF circuit (not depicted).

Typically, the feed line 5 is made of copper foil in a layer different from the layer of the first conductor plane 1 in a multilayer printed circuit board and a dielectric substrate (not depicted) is inserted between the first conductor plane 1 and the feed line 5 and supports them. However, the antenna 20 of the second exemplary embodiment does not necessarily need to be formed in a multilayer printed circuit board. For example, components made from a metal sheet may be partially supported by dielectric supports. In that case, the part other than the dielectric supports is hollow and therefore dielectric loss can be reduced and the radiation efficiency of the antenna can be improved. While typically the first feed conductor via 21 and the second feed conductor via 22 are formed by plating through-holes drilled in the dielectric substrate, the formation of the vias 21 and 22 is not limited to this. The feed conductor vias 21 and 22 may be any structures that can electrically interconnect the layer of the first conductor plane 1 and the layer of the plane that face the first conductor plane 1.

While the mode of connections between branch lines 5*a*, 5*b* and the split ring resonators 2, 3 in the antenna 20 in FIG. 6 is the same as the mode of connections in the antenna 10 in FIG. 1, i.e. one end of the first branch line 5*a* is connected to the first right arm portion 12*b* and one end of the second branch line 5*b* is connected to the second left arm portion 15*a*, the mode of connections is not limited to this. For example, one end of the first branch line 5*a* may be connected to the first left arm portion 12*a* and one end of the second branch line 5*b* may be connected to the second right arm portion 15*b* as in the configuration in FIG. 2. Since a clearance does not need to be provided in the first conductor plane 1 of the antenna 20 of the second exemplary embodiment, unnecessary electromagnetic radiation from the feed line 5 to the outside world can be reduced as compared with the antenna 10 of the first exemplary embodiment.

Third Exemplary Embodiment

Figure 7:
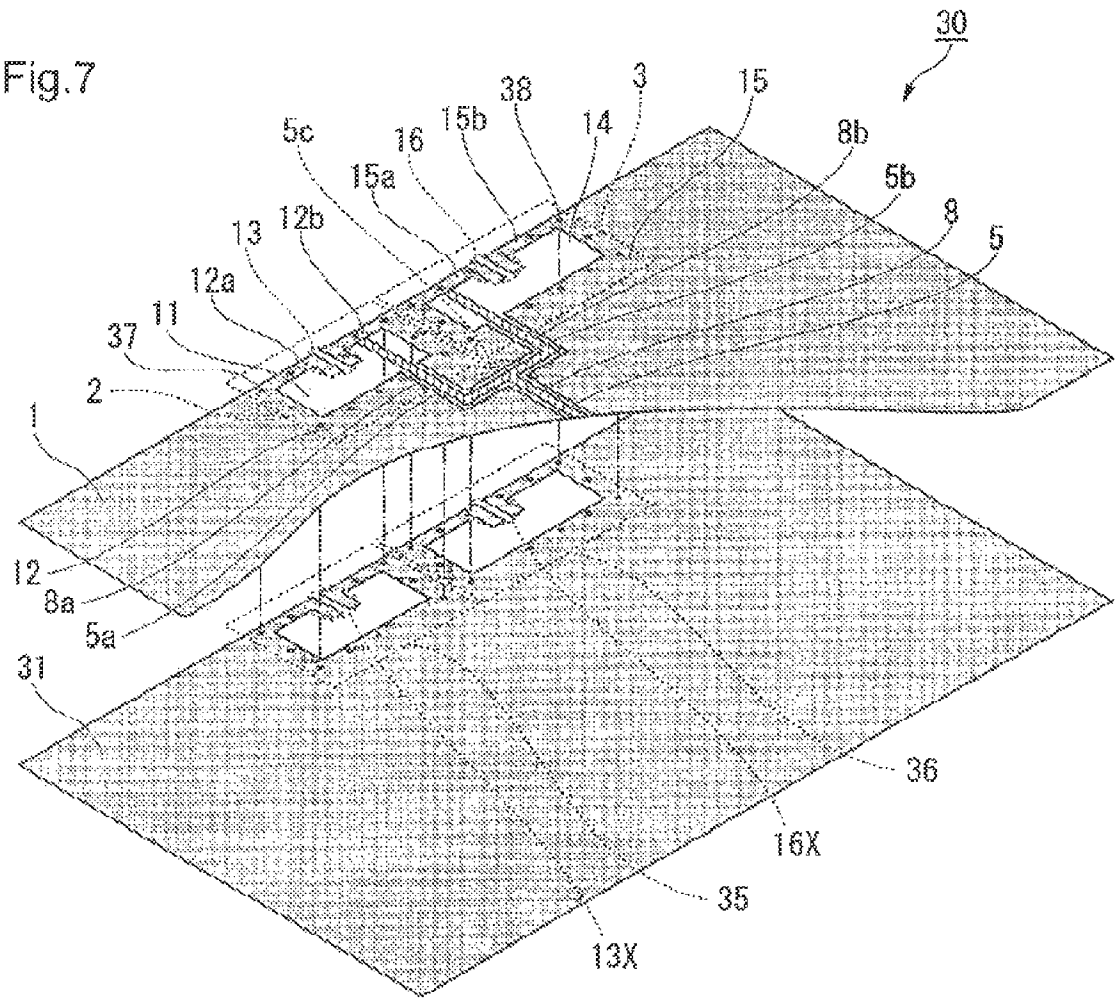
FIG. 7 is a perspective view of an antenna according to a third exemplary embodiment of the present invention.

FIG. 7 is a perspective view of an antenna 30 according to a third exemplary embodiment of the present invention. In the antenna 30 in FIG. 7, the same components as those of the antenna 10 in FIG. 1 are given the same reference numerals and the description thereof will be simplified. The antenna 30 has a configuration similar to that of the antenna 10 and differences between the two will be described. While the antenna 30 of the third exemplary embodiment has been designed on the basis of the antenna 10 of the first exemplary embodiment, a second conductor plane 31 including a third split ring resonator 35 and a fourth split ring resonator 36 is provided in such a manner that the second conductor plane 31 faces a first conductor plane 1.

In the antenna 30 in FIG. 7, the third split ring resonator 35 is disposed so as to coincide with the first split ring resonator 2 in plan view. In a first conductor region 12 of a first split ring resonator 2, a plurality of conductor vias 37 are provided in the circumferential direction (i.e. in the direction along the opening edge of a first opening 11) with a predetermined distance between the conductor vias 37. With this arrangement, the first split ring resonator 2 is electrically connected to the third split ring resonator 35 through the plurality of conductor vias 37. The fourth split ring resonator 36 is disposed so as coincide with the second split ring resonator 3 in plan view. In a second conductor region 15 of a second split ring resonator 3, a plurality of conductor vias 38 are provided in the circumferential direction (i.e. in the direction along the opening edge of a second opening 14) with a predetermined distance between the conductor vias 38. With this arrangement, the second split ring resonator 3 is electrically connected to the fourth split ring resonator 36 through the plurality of conductor vias 38.

Since the first split ring resonator 2 and the third split ring resonator 35 in the antenna 30 of the third exemplary embodiment are interconnected through the plurality of conductor vias 37, the first split ring resonator 2 and the third split ring resonator 35 operate as a single split ring resonator. In the split ring resonators 2 and 35, capacitances formed by split portions (i.e. a first split portion 13 and a third split portion 13X) are connected in parallel. Accordingly, the split ring resonators can achieve a lower resonant frequency than that achieved by the antenna 10 of the first exemplary embodiment. Furthermore, since the second split ring resonator 3 and the fourth split ring resonator 36 are interconnected through the plurality of conductor vias 38, the second split ring resonator 3 and the forth split ring resonator 36 operate as a single split ring resonator. In the split ring resonators 3, 36, capacitances formed by split portions (i.e. a second split portion 16 and a fourth split portion 16X) are connected in parallel. Accordingly, the split ring resonators can achieve a lower resonant frequency than that achieved by the antenna 10 of the first exemplary embodiment.

Typically, the second conductor plane 31 is made of copper foil in a layer in a multilayer printed circuit board that is different from the layer of the first conductor plane 1 and a dielectric substrate (not depicted) is provided between the first conductor plane 1 and the second conductor plane 31 and supports the first conductor plane 1 and the second conductor plane 31. However, the antenna 30 of the third exemplary embodiment does not necessarily need to be formed in a multilayer printed circuit board. For example, a component made from a metal sheet may be partially supported by dielectric supports. In that case, the part other than the dielectric supports is hollow and therefore dielectric loss can be reduced and the radiation efficiency of the antenna can be improved. While typically the conductor vias 37, 38 are formed by plating through-holes drilled in the dielectric substrate, the formation of the vias 37 and 38 is not limited to this. The conductor vias 37, 38 may be any structures that can electrically interconnect the layer of the first conductor plane 1 and the layer of the second conductor plane 31.

While the mode of connections between branch lines 5*a*, 5*b* and the split ring resonators 2, 3 in the antenna 30 in FIG. 7 is the same as the mode of connections in the antenna 10 in FIG. 1, i.e. one end of the first branch line 5*a* is connected to a first right arm portion 12*b* and one end of the second branch line 5*b* is connected to a second left arm portion 15*a*, the mode of connections is not limited to this. For example, one end of the first branch line 5*a* may be connected to a first left arm portion 12*a* and one end of the second branch line 5*b* may be connected to a second right arm portion 15*b* as in the configuration in FIG. 2.

Figure 8:
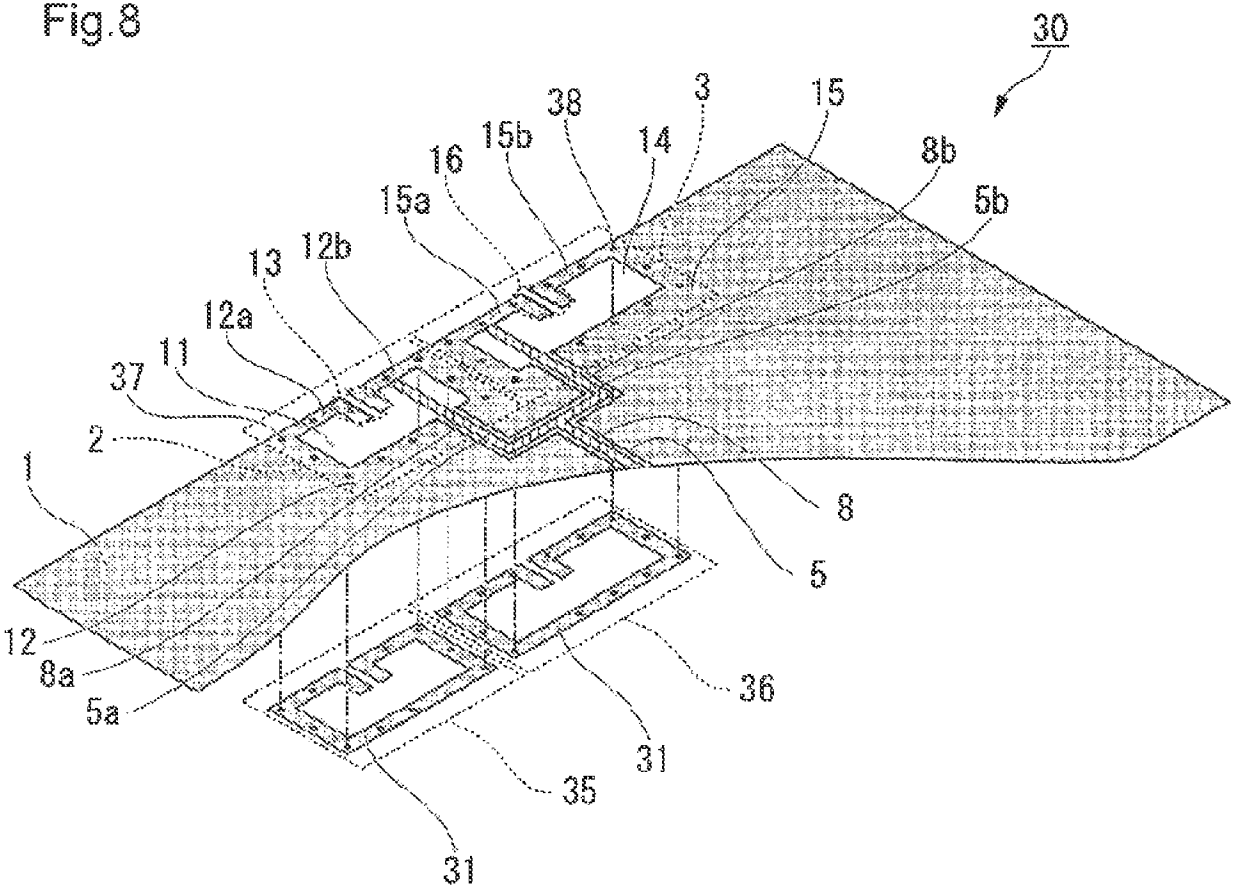
FIG. 8 is a perspective view of a variation of the antenna of the third exemplary embodiment of the present invention.

FIG. 8 is a perspective view of a variation of the antenna 30 according to the third exemplary embodiment. While the second conductor plane 31 in the configuration in FIG. 7 is the same as the first conductor plane 1 in shape and size, the configuration is not limited to this. The second conductor plane 31 may be in any shape that includes the third split ring resonator 35 and the fourth split ring resonator 36. In the configuration in FIG. 8, the second conductor plane 31 is separated into two regions, only belt-like conductors are left and split ring resonators 35 and 36 are formed in the separate regions.

While the second conductor plane 31 is provided in a single layer in FIGS. 7 and 8, a plurality of conductor planes 31 may be provided in different layers. For example, layouts each similar to the layout of the second conductor plane 31 illustrated in FIG. 7 may be provided in different layers. Alternatively, a region in the second conductor plane 31 illustrated in FIG. 8 that faces the split ring resonator 2 and a region in the second conductor plane 31 that faces the split ring resonator 3 may be provided in different layers. Furthermore, the second conductor plane 31 in FIG. 7 and the second conductor plane 31 in FIG. 8 may be combined and provided in different layers.

Fourth Exemplary Embodiment

Figure 9:
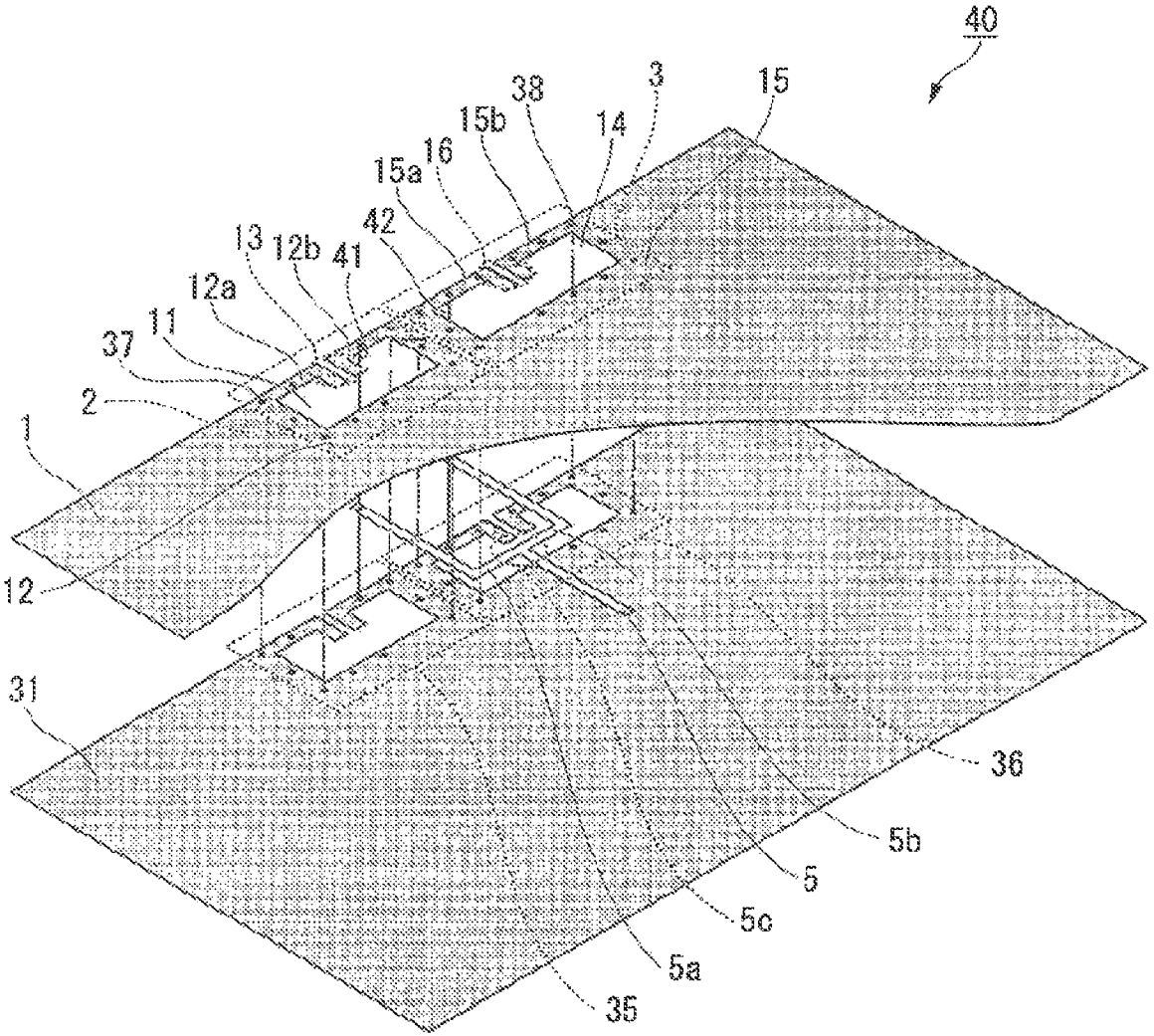
FIG. 9 is a perspective view of an antenna according to a fourth exemplary embodiment of the present invention.

FIG. 9 is a perspective view of an antenna 40 according to a fourth exemplary embodiment of the present invention. In the antenna 40 in FIG. 9, the same components as those of the antenna 10 in FIG. 1 and the antenna 30 in FIG. 7 are given the same reference numerals and the description thereof will be simplified. The antenna 40 has a configuration similar to those of the antennas 10 and 30 and differences from them will be described. While the antenna 40 of the fourth exemplary embodiment has been designed on the basis of the antenna 30 of the third exemplary embodiment, a feed line 5 is disposed in a plane between a first conductor plane 1 and a second conductor plane 31 in such a manner that the feed line 5 faces the first conductor plane 1 and the second conductor plane 31.

One end of a first branch line 5*a* of the feed line 5 is connected to a first split ring resonator 2 and a third split ring resonator 35 through a first feed conductor via 41. The other end extends in the plane that faces the first conductor plane 1 and the second conductor plane 31 across a first opening 11 and a first conductor region 12 and is connected to a branch portion 5*c*. One end of a second branch line 5*b* is connected to a second split ring resonator 3 and a fourth split ring resonator 36 through a second feed conductor via 42. The other end extends in the plane that faces the first conductor plane 1 and the second conductor plane 31 across a second opening 14 and a second conductor region 15 and is connected to the branch portion 5*c*. The first branch line 5*a* and the second branch line 5*b* of the feed line 5 extend and connect to the branch portion 5*c* and the feed line 5 further extends in one direction to connect to an RF circuit (not depicted).

Typically, the feed line 5 is formed from copper foil between the layer of the first conductor plane 1 and the layer of the second conductor plane 31 in a multilayer printed circuit board and a dielectric substrate (not depicted) is inserted between the first conductor plane 1 and the feed line 5 and a dielectric substrate (not depicted) is inserted between the feed line 5 and the second conductor plane 31 and the dielectric substrates support them. However, the antenna 40 of the fourth exemplary embodiment does not necessarily need to be formed in a multilayer printed circuit board. For example, components made from a metal sheet may be partially supported by dielectric supports. In that case, the part other than the dielectric supports is hollow and therefore dielectric loss can be reduced and the radiation efficiency of the antenna can be improved. While typically the first feed conductor via 41 and the second feed conductor via 42 are formed by plating through-holes drilled in the dielectric substrates, the formation of the vias 41 and 42 is not limited to this. The feed conductor vias 41, 42 may be any structures that can electrically interconnect the layer of the first conductor plane 1 and the layer of the second conductor plane 31.

While the mode of connections between branch lines 5*a*, 5*b* and the split ring resonators 2, 3 in the antenna 40 in FIG. 9 is the same as the mode of connections in the antenna 10 in FIG. 1, i.e. one end of the first branch line 5*a* is connected to a first right arm portion 12*b* and one end of the second branch line 5*b* is connected to a second left arm portion 15*a*, the connection mode is not limited to this. For example, one end of the first branch line 5*a* may be connected to a first left arm portion 12*a* and one end of the second branch line 5*b* may be connected to a second right arm portion 15*b* as in the configuration in FIG. 2. Since the feed line 5 in the antenna 40 of the fourth exemplary embodiment is formed in a plane that is different from the first conductor plane 1 and the second conductor plane 31, a clearance does not need to be provided in the first conductor plane 1 and the second conductor plane 31. Accordingly, unnecessary electromagnetic radiation from the feed line 5 to the outside world can be reduced as compared with the antenna 10 of the first exemplary embodiment.

Fifth Exemplary Embodiment

Figure 10:
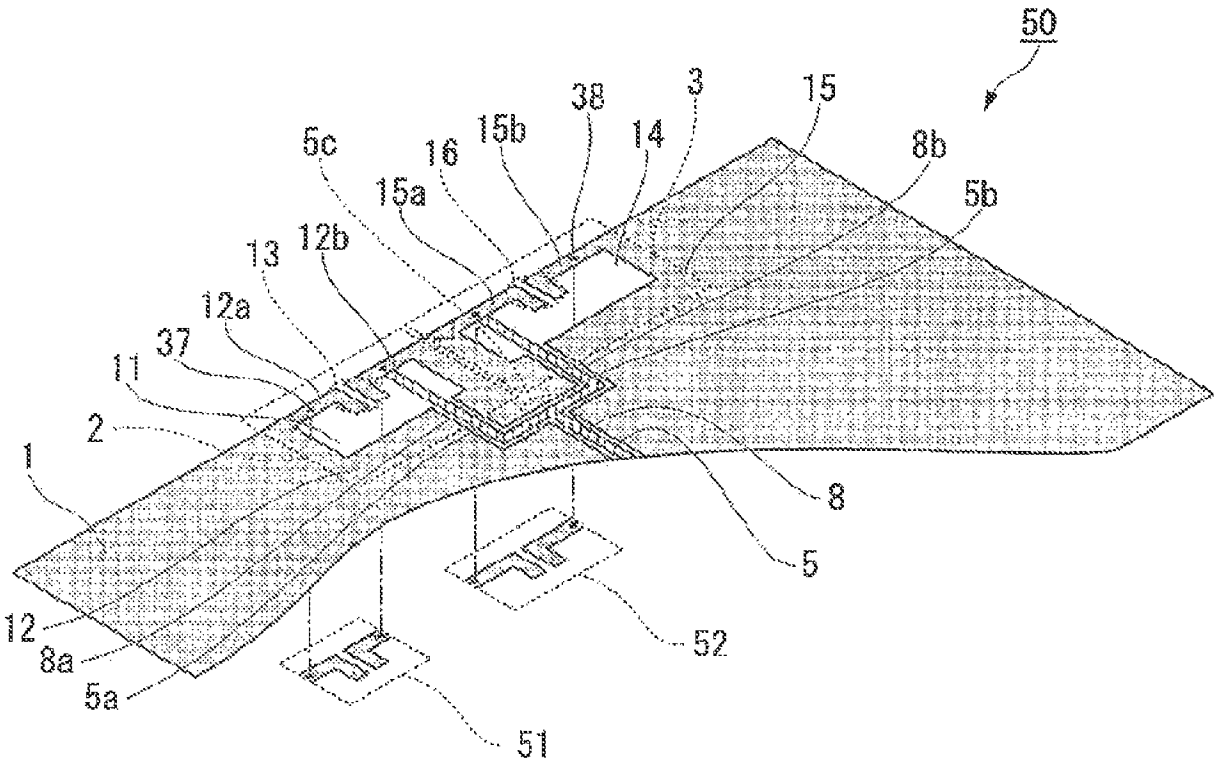
FIG. 10 is a perspective view of an antenna according to a fifth exemplary embodiment of the present invention.

FIG. 10 is a perspective view of an antenna 50 according to a fifth exemplary embodiment of the present invention. In the antenna 50 in FIG. 10, the same components as those of the antenna 10 in FIG. 1 and the antenna 30 in FIG. 8 are given the same reference numerals and the description thereof will be simplified. The antenna 50 has a configuration similar to those of the antennas 10 and 30 and differences from them will be described.

In the antenna 50 in FIG. 10, a first auxiliary conductor 51 and a second auxiliary conductor 52 are disposed in a plane different from a first conductor plane 1 in such a manner that the auxiliary conductors 51 and 52 face the first conductor plane 1. The first auxiliary conductor 51 is made up of two separate conductor pieces, which are connected to a first left arm portion 12*a* and a first right arm portion 12*b* through conductor vias 37. Since the first auxiliary conductor 51 faces a first split ring resonator 2, capacitance formed across a first split portion 13 can be increased. Accordingly, the resonant frequency of the first split ring resonator 2 can be decreased without increasing the size of the first split ring resonator 2. Furthermore, the second auxiliary conductor 52 is made up of two separate conductor pieces, which are connected to a second left arm portion 15*a* and a second right arm portion 15*b* through conductor vias 38. Since the second auxiliary conductor 52 faces a second split ring resonator 3, the capacitance formed across a second split portion 16 can be increased. Accordingly, the resonant frequency of the second split ring resonator 3 can be decreased without increasing the size of the second split ring resonator 3.

Typically, the first auxiliary conductor 51 and the second auxiliary conductor 52 are formed from copper foil in a layer in a multilayer printed circuit board that is different from the layer of the first conductor plane 1 and a dielectric substrate (not depicted) supports the first conductor plane 1 and the auxiliary conductors 51, 52. However, the antenna 50 of the fifth exemplary embodiment does not necessarily need to be formed in a multilayer printed circuit board. For example, components made from a metal sheet may be partially supported by dielectric supports. In that case, the part other than the dielectric supports is hollow and therefore dielectric loss can be reduced and the radiation efficiency of the antenna can be improved. While typically the conductor vias 37, 38 are formed by plating through-holes drilled in the dielectric substrate, the formation of the vias 37, 38 is not limited to this. The conductor vias 37, 38 may be any structures that can electrically interconnect the layer of first conductor plane 1 and the layer of the auxiliary conductors 51, 52.

Figure 11:
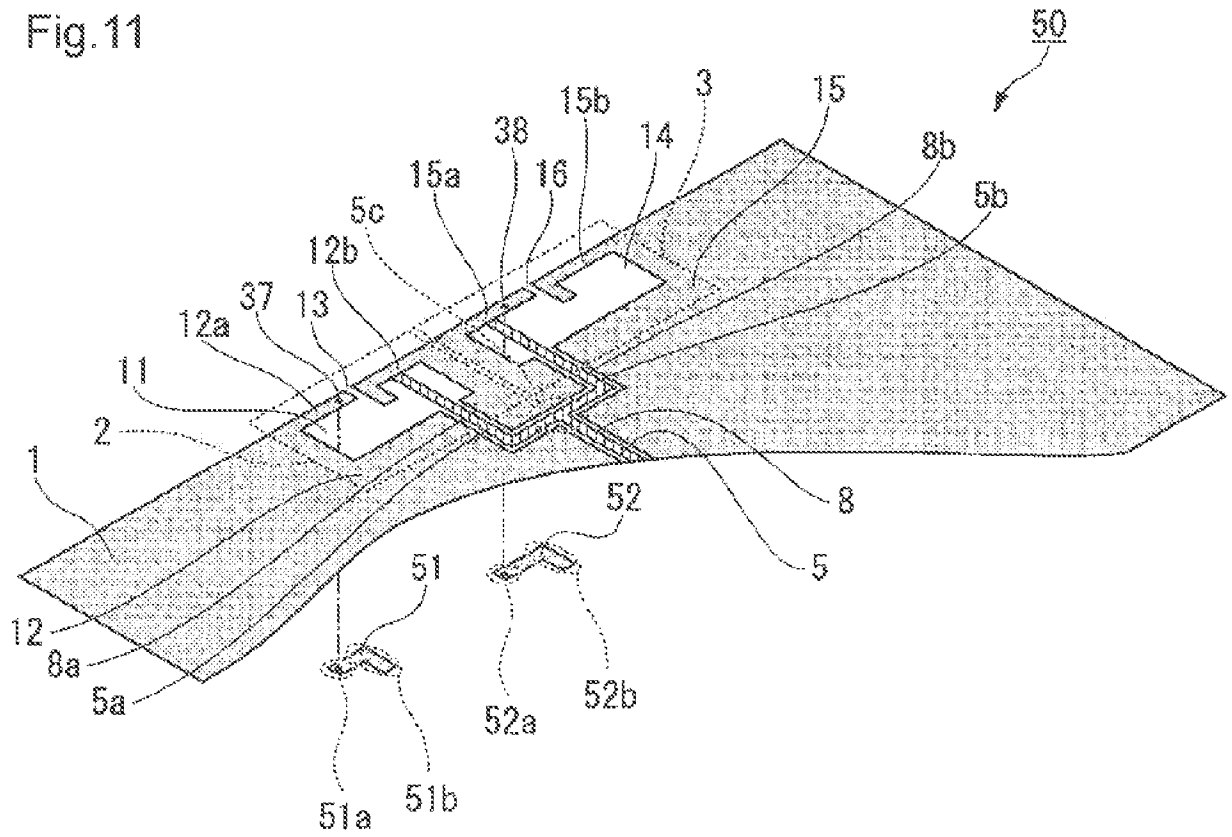
FIG. 11 is a perspective view of a variation of the antenna of the fifth exemplary embodiment.
Figure 12:
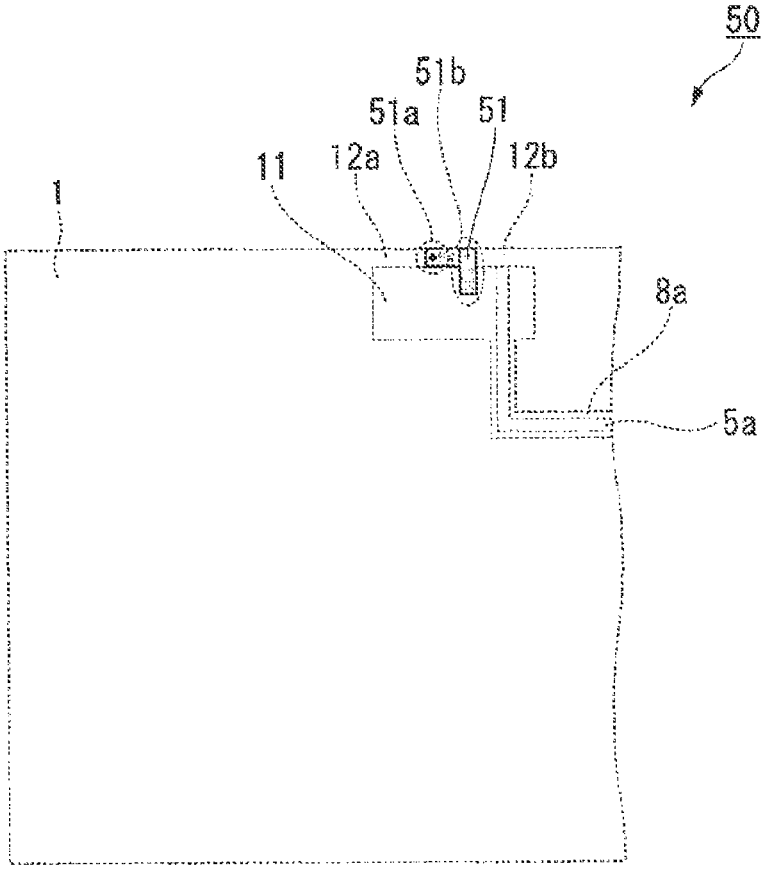
FIG. 12 is a plan view of a variation of an antenna of the fifth exemplary embodiment.

FIGS. 11 and 12 are a perspective view and a plan view, respectively, of an antenna according to a variation of the fifth exemplary embodiment. While each of the auxiliary conductors 51, 52 in the antenna in FIG. 10 is made up of two conductor pieces, they are not so limited. The auxiliary conductors 51, 52 may have any structure and shape that increase the capacitance formed by the split portions 13, 16.

In the plan view of FIG. 12, a layer in which the first auxiliary conductor 51 is provided is indicated by solid lines and a layer in which a first conductor plane 1 is provided is indicated by dashed lines. As illustrated in FIGS. 11 and 12, the first auxiliary conductor 51 includes a first connection portion 51*a* connected to one end (i.e. a first left arm portion 12*a*) of a first conductor region 12 cut by a first split portion 13 and a first capacitance formation portion 51*b* which is disposed in such a manner that the first capacitance formation portion 51*b* faces and coincides with the other end (i.e. a first right arm portion 12*b*) of the first conductor region 12 in plan view and forms a predetermined capacitance. The second auxiliary conductor 52 includes a second connection portion 52*a* connected to one end (i.e. a second left arm portion 15*a*) of a second conductor region 15 cut by a second split portion 16 and a second capacitance formation portion 52*b* which is disposed in such a manner that the second capacitance formation portion 52*b* faces and coincides with the other end (i.e. a second right arm portion 15*b*) of the second conductor region 15 in plan view and forms a predetermined capacitance.

In this way, a capacitor is formed between the first auxiliary conductor 51 and the first right arm portion 12*b*, which can increase the capacitance formed across the first split portion 13. In addition, a capacitor is formed between the second auxiliary conductor 52 and the second right arm portion 15*b*, which can increase the capacitance formed across the second split portion 16. Alternatively, the connection portion 51*a*, 52*a* of each of the auxiliary conductors 51, 52 may be connected to the other end (i.e. the first right arm portion 12*b*, the second right arm portion 15*b*) of the conductor region 12, 15 to form a capacitance. Note that only one of the auxiliary conductors 51, 52 may be provided depending on the resonant frequency of the split ring resonators 2, 3.

While the mode of connections between branch lines 5*a*, 5*b* and the split ring resonators 2, 3 in the antenna 50 illustrated in any of FIGS. 10, 11 and 12 is the same as the mode of connections in the antenna 10 in FIG. 1, i.e. one end of the first branch line 5*a* is connected to the first right arm portion 12*b* and one end of the second branch line 5*b* is connected to the second left arm portion 15*a*, the connection mode is not limited to this. For example, one end of the first branch line 5*a* may be connected to the first left arm portion 12*a* and one end of the second branch line 5*b* may be connected to the second right arm portion 15*b* as in the configuration in FIG. 2.

Sixth Exemplary Embodiment

Figure 13:
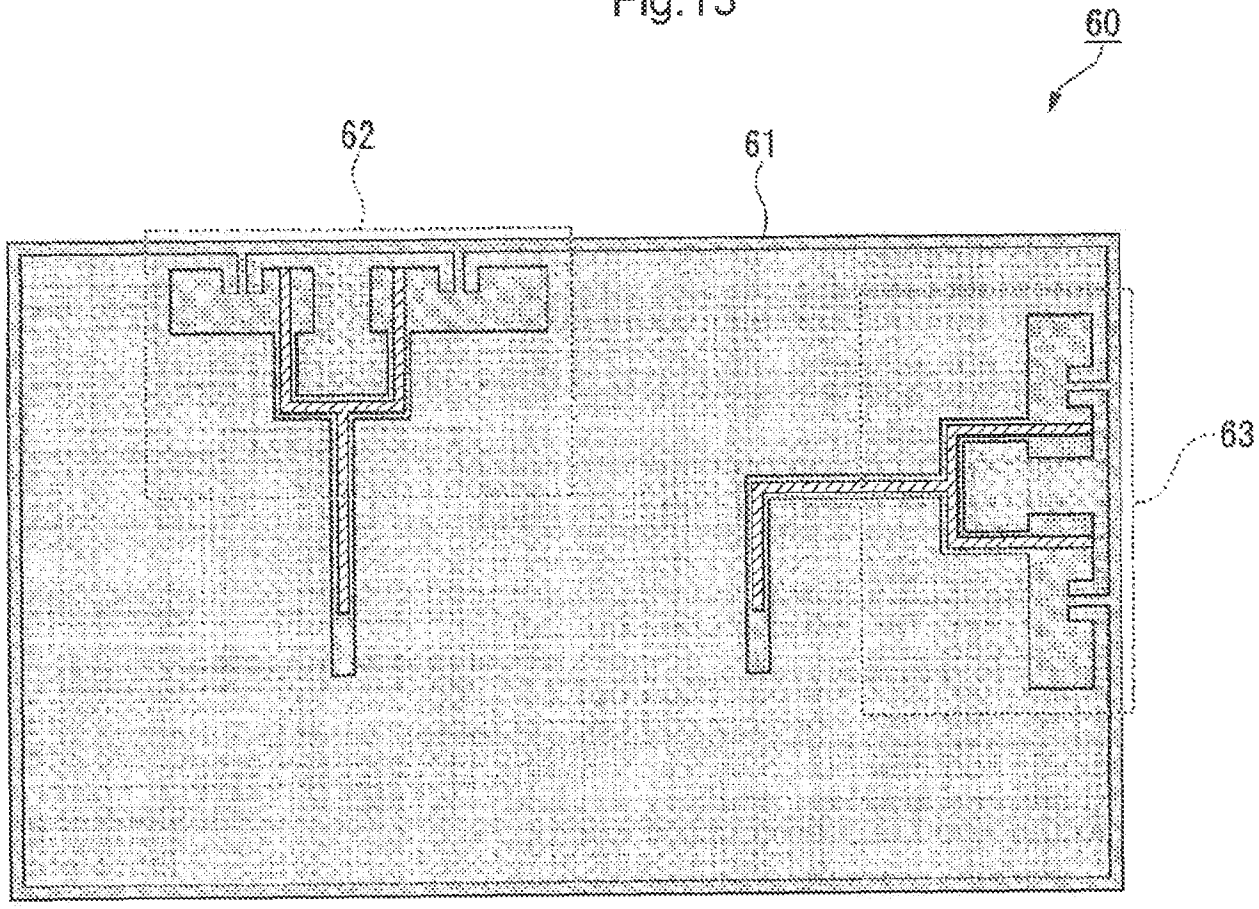
FIG. 13 is a plan view of a wireless communication device according to a sixth exemplary embodiment of the present invention.

FIG. 13 is a plan view of a wireless communication device 60 according to a sixth exemplary embodiment of the present invention. The wireless communication device 60 according to the sixth exemplary embodiment includes two antennas 10 according to the first exemplary embodiment. The wireless communication device 60 of the sixth exemplary embodiment includes a first antenna 62 and a second antenna 63 that have the same configuration as the antenna 10 of the first exemplary embodiment in any of the layers in a multilayer printed circuit board 61. Accordingly, the wireless communication device 60 can be used with a communication method that requires a plurality of antennas, such as MIMO (Multiple Input Multiple Output), for example. In order to achieve a high throughput with the MIMO communication method, it is desirable that the coefficient of correlation between the plurality of antennas be low. The coefficient of correlation between the two antennas 62 and 63 can be reduced by orienting the first antenna 62 and the second antenna 63 at right angles to one another as illustrated in FIG. 13.

While the first antenna 62 and the second antenna 63 are oriented at right angles to one another in the wireless communication device 60 in FIG. 13, whether or not the two antennas are oriented at right angles to one another does not influence the effects of this exemplary embodiment. Furthermore, while the antennas 62, 63 are used in the wireless communication device 60 of the sixth exemplary embodiment having the same configuration as the antenna 10 of the first exemplary embodiment, the antennas are not limited to this. Specifically, any of the antennas 20 to 50 of the second to fifth exemplary embodiment may be used as the antennas 62, 63 of the wireless communication device 60. Furthermore, a plurality of antennas 62, 63 embedded in the wireless communication device 60 do not need to have the same configuration and any of the antennas according to the exemplary embodiments described above may be selectively used. While two antennas 62, 63 are embedded in the wireless communication device 60 of the sixth exemplary embodiment, three or more antennas may be embedded.

Figure 14:
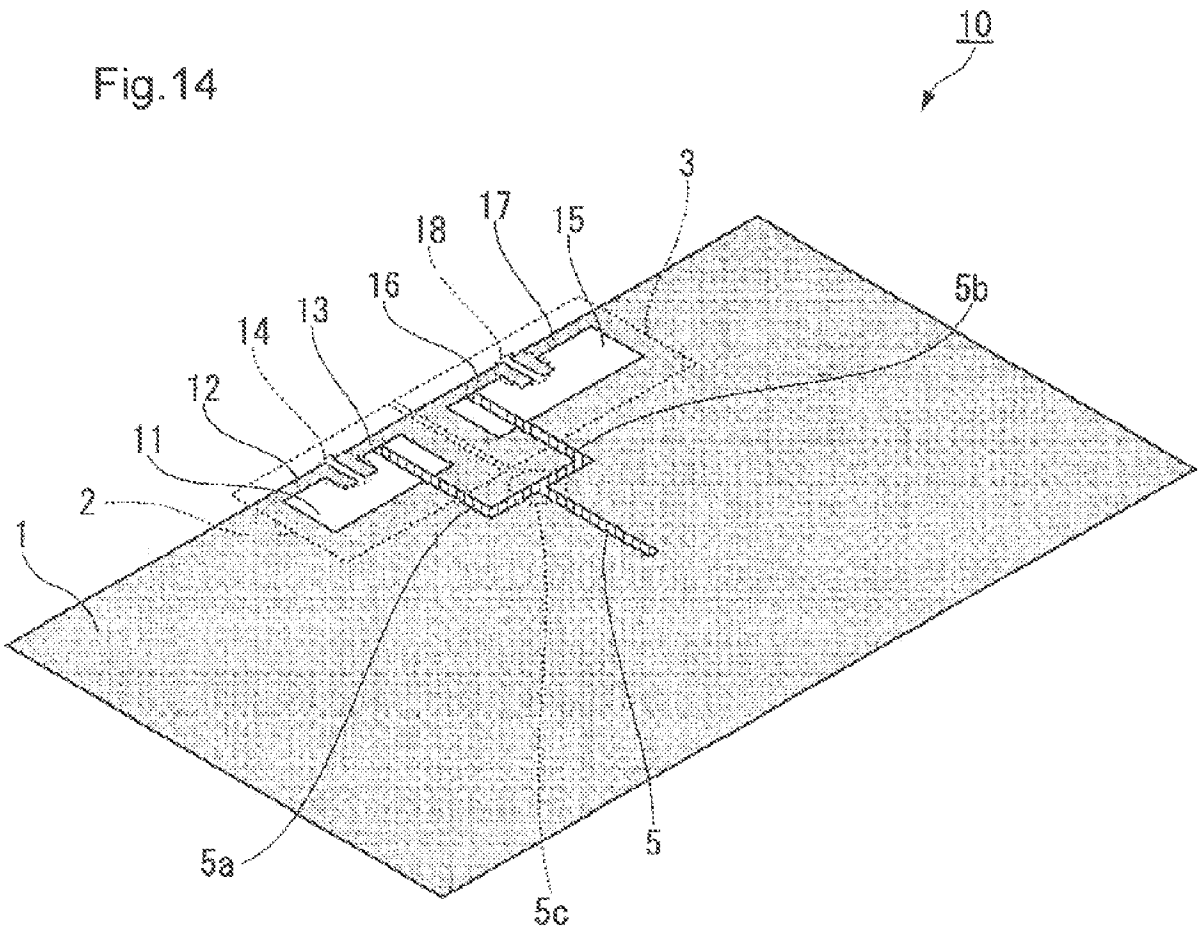
FIG. 14 is a perspective view illustrating a minimal configuration of an antenna according to any of the exemplary embodiments noted above.

FIG. 14 is a perspective view illustrating a minimum configuration of an antenna 10 according to the present invention. As illustrated in FIG. 14, the antenna 10 of the present invention includes at least a first conductor plane 1 including a first split ring resonator 2 and a second split ring resonator 3, and a feed line 5 including a first branch line 5*a*, a second branch line 5*b* and a branch portion 5*c*. The first split ring resonator 2 includes a first conductor region 12 along the opening edge of a first opening 11 formed in the first conductor plane 1 and a first split portion 13 formed by cutting a portion of the first conductor region 12. The second split ring resonator 3 includes a second conductor region 15 along the opening edge of a second opening 14 formed in the first conductor plane 1 and a second split portion 16 formed by cutting a portion of the second conductor region 15. One end of the first branch line 5*a* is connected to the first split ring resonator 2 and the other end extends to the branch portion 5*c* across the first conductor region 12. One end of the second branch line 5*b* is connected to the second split ring resonator 3 and the other end extends to the branch portion 5*c* across the second conductor region 15.

Seventh Exemplary Embodiment

Figure 17:
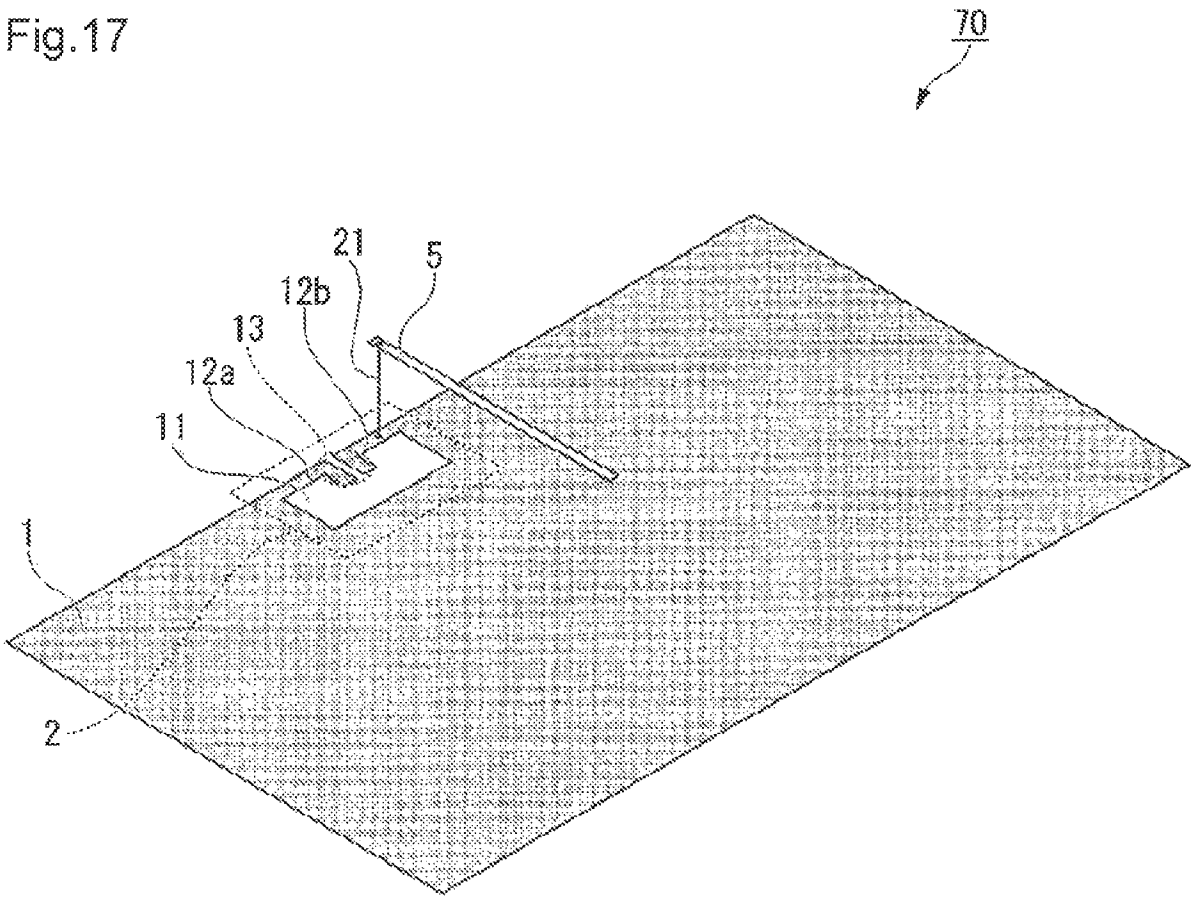
FIG. 17 is a perspective view of an antenna according to a seventh exemplary embodiment of the present invention.

FIG. 17 is a perspective view of an antenna 70 according to a seventh exemplary embodiment of the present invention. While multiband antennas which operate at multiple frequencies have been described in the exemplary embodiments given above, the present invention is not limited to this. The present invention is also applicable to a single-band antenna which includes only one split ring resonator. The seventh exemplary embodiment in which the present invention is applied to a single-band antenna will be described below.

As illustrated in FIG. 17, the antenna 70 of the seventh exemplary embodiment has a configuration that uses only the first split ring resonator 2 of the antenna 20 of the second exemplary embodiment and includes the following structural features. A first split ring resonator 2 alone is provided in a first conductor plane 1 and the second split ring resonator 3 is not provided. The feed line 5 does not have a branch portion and one end of the feed line 5 is connected to a first right arm portion 12*b* on the periphery of the first split ring resonator 2 through a first feed conductor via 21 and the other end extends in a region that faces the first conductor plane 1 across a first opening 11 in plan view. A high-frequency signal from an RF circuit (not depicted) is provided to the first split ring resonator 2 through the feed line 5. As in the second exemplary embodiment, the antenna 70 of the seventh exemplary embodiment operates around the resonant frequency of the first split ring resonator 2. At least one antenna 70 can be provided in an electronic device including communication functionality. In this case, the whole size of the electronic device provided with the antenna 70 can be reduced because the antenna 70 can be reduced in size.

The configuration of the single-band antenna 70 according to the seventh exemplary embodiment is not limited to the one illustrated in FIG. 17. Specifically, while the antenna 70 in FIG. 17 has been designed on the basis of the configuration of the second exemplary embodiment, the antenna 70 may be designed on the basis of the configuration of any of the other exemplary embodiments.

Figure 18:
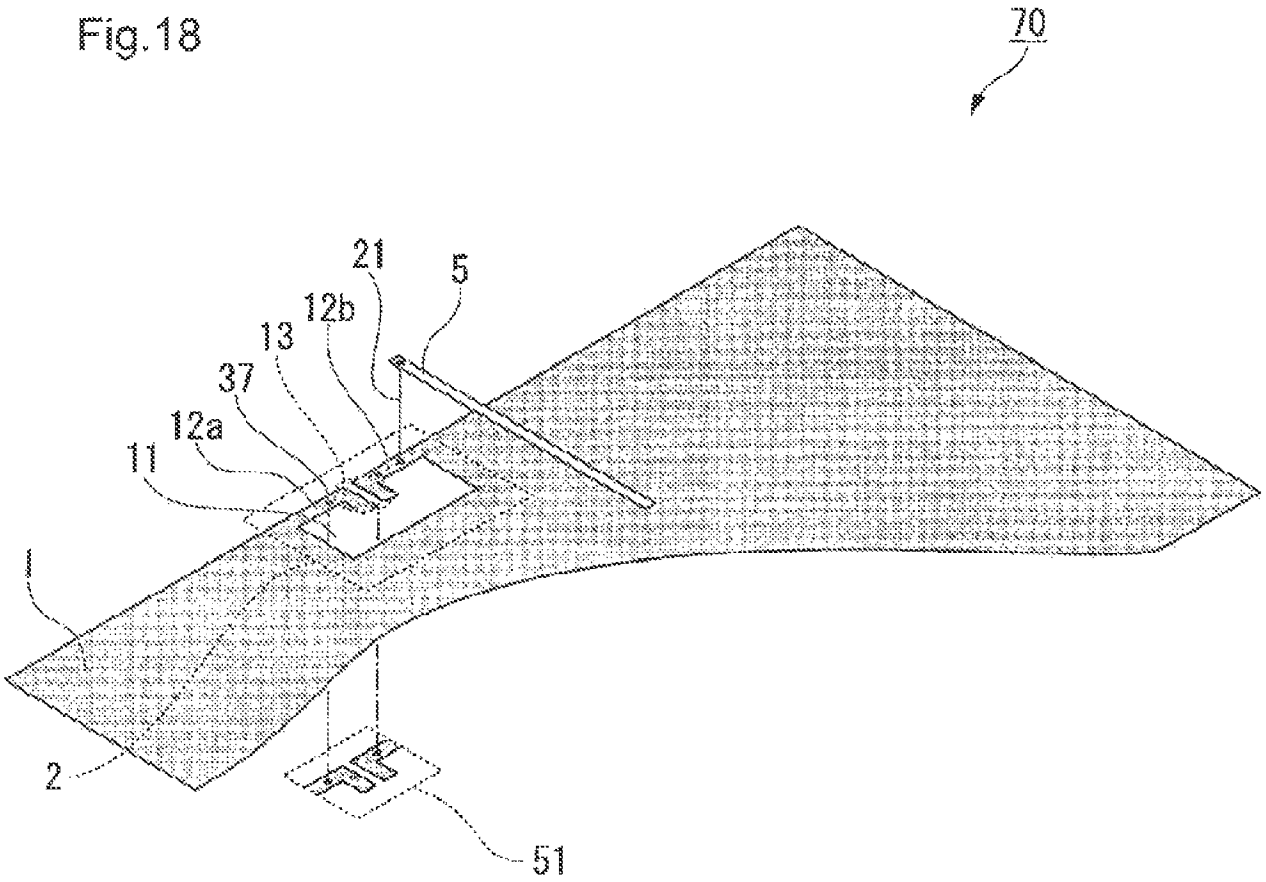
FIG. 18 is a perspective view of an antenna according to a first variation of the seventh exemplary embodiment.

FIG. 18 is a perspective view of an antenna 70 according to a first variation of the seventh exemplary embodiment and the antenna 70 has been designed on the basis of the configuration of the fifth exemplary embodiment. Specifically, the antenna 70 may include a first auxiliary conductor 51. The first auxiliary conductor is made up of two separate conductor pieces, which are connected to a first left arm portion 12*a* and a first right arm portion 12*b* through conductor vias 37. Since the configuration in FIG. 18 can increase the capacitance formed across a first split portion 13, the resonant frequency of the first split ring resonator 2 can be decreased without increasing the whole size of the antenna 70.

Figure 19:
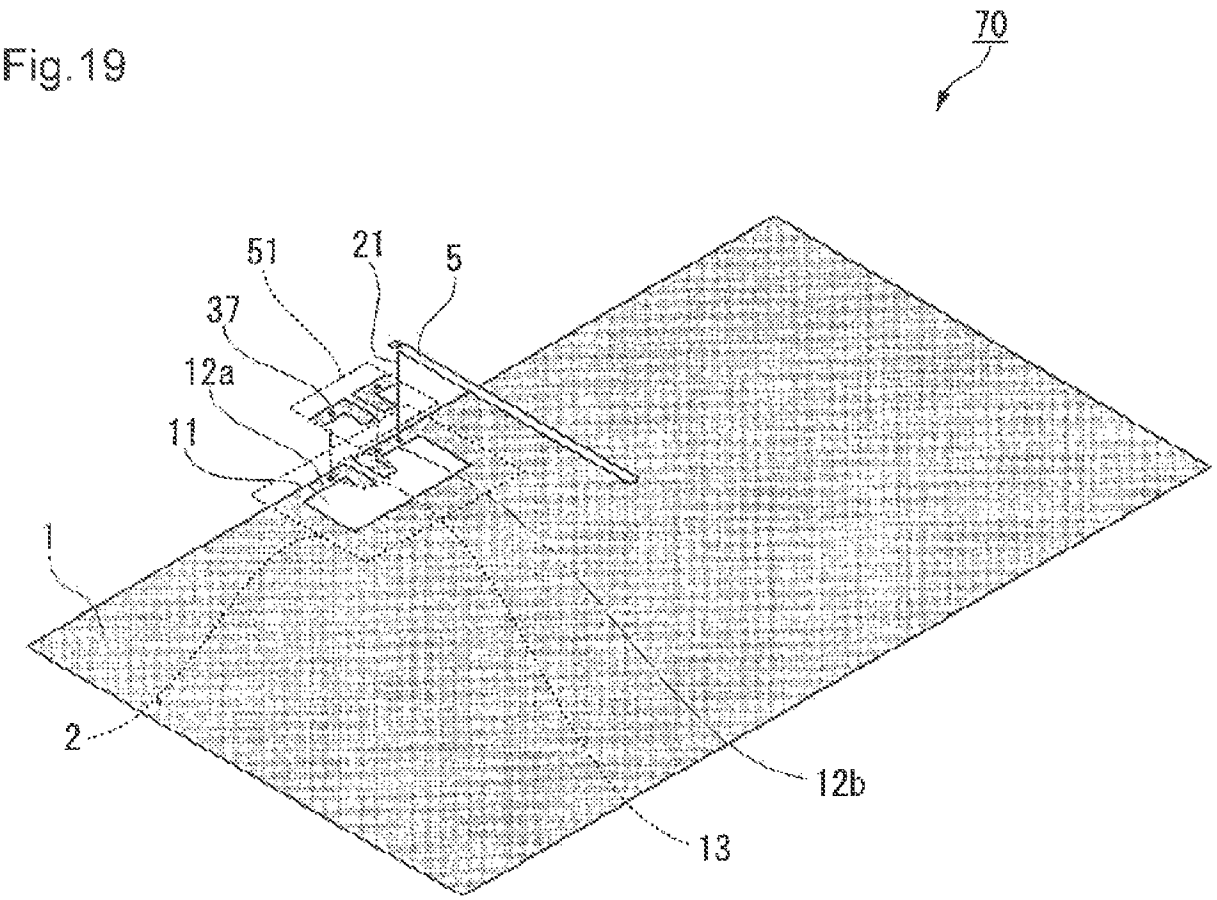
FIG. 19 is a perspective view of an antenna according to a second variation of the seventh exemplary embodiment.

FIG. 19 is a perspective view of an antenna 70 according to a second variation of the seventh exemplary embodiment. The first auxiliary conductor 51 needs only to increase the capacitance formed across the first split portion 13 and does not necessarily need to be disposed on the side opposite from the feed line 5 with respect to the first conductor plane 1 as illustrated in FIG. 18. The first auxiliary conductor 51 and the feed line 5 may be disposed in the same layer as illustrated in FIG. 19.

Figure 20:
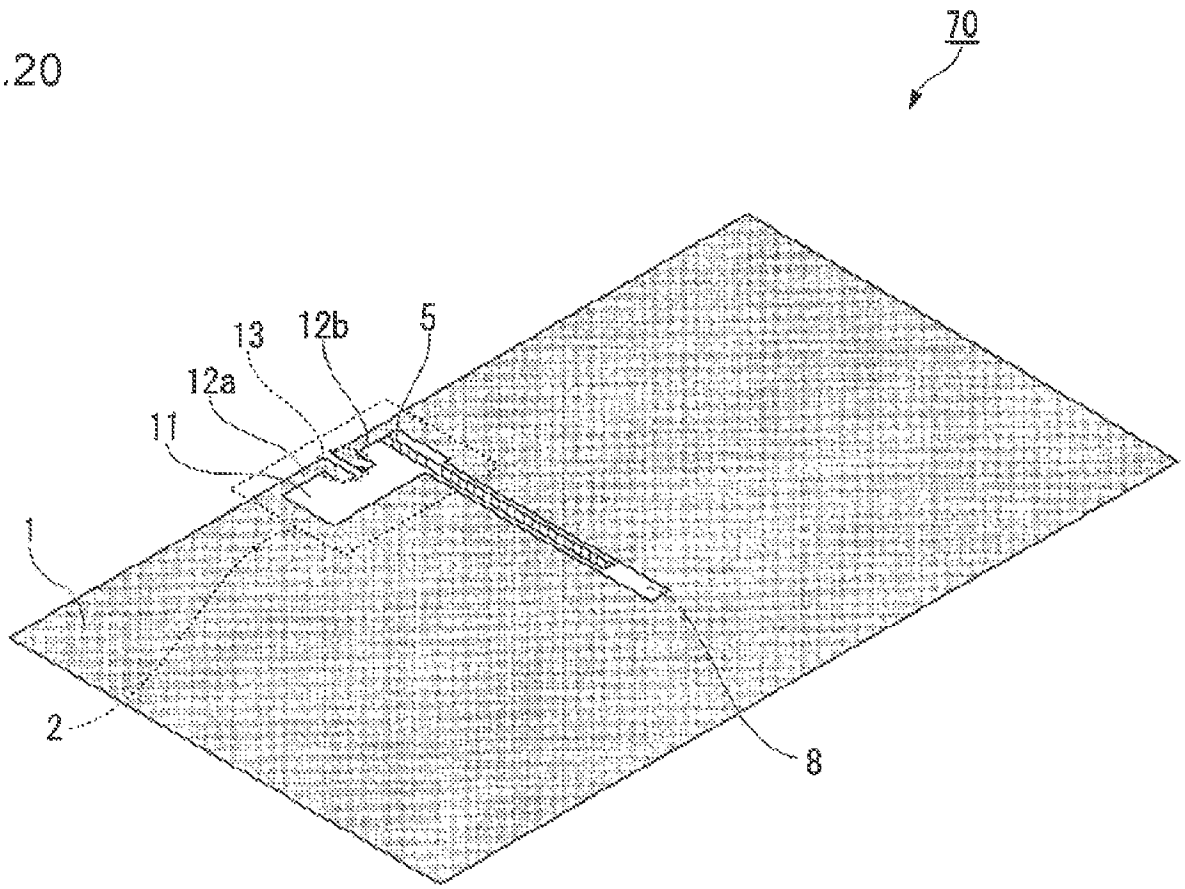
FIG. 20 is a perspective view of an antenna according to a third variation of the seventh exemplary embodiment.

FIG. 20 is a perspective view of an antenna 70 according to a third variation of the seventh exemplary embodiment. The antenna 70 in FIG. 20 has been designed on the basis of the first exemplary embodiment and a first conductor plane 1 and a feed line 5 are formed in the same layer. One end of the feed line 5 is connected to a first right arm portion 12*b* on a periphery of a first split ring resonator 2 and the other end extends inside a clearance 8 formed extending toward the other side of the first conductor plane 1 across a first opening 11 in plan view. The other end of the feed line 5 is connected to an RF circuit (not depicted). Since the configuration in FIG. 20 allows the antenna 70 to be formed in a single conductor layer, the electronic device equipped with the antenna 70 can be made low-profile.

Lastly, antennas and wireless communication devices according to the present invention are not limited to the exemplary embodiments described above; the present invention encompasses various design variations and modifications within the scope of the present invention defined in the appended claims.

INDUSTRIAL APPLICABILITY

The present invention provides an antenna in which a plurality of split ring resonators operating in a plurality of frequency bands are compactly arranged and is suitably applicable to wireless communication devices such as mobile terminals conforming to various wireless-LAN and MIMO communication methods.

REFERENCE SIGNS LIST

1 . . . First conductor plane
2 . . . First split ring resonator
3 . . . Second split ring resonator
5 . . . Feed line
5*a* . . . First branch line
5*b* . . . Second branch line
5*c* . . . Branch portion
8 . . . Clearance
8*a* . . . First branch clearance
8*b* . . . Second branch clearance
10, 20, 30, 40, 50 . . . Antenna
11 . . . First opening
12 . . . First conductor region
12*a* . . . First left arm portion
12*b* . . . First right arm portion
13 . . . First split portion
15 . . . Second conductor region
15*a* . . . Second left arm portion
15*b* . . . Second right arm portion
16 . . . Second split portion
21, 41 . . . First feed conductor via
22, 42 . . . Second feed conductor via
31 . . . Second conductor plane
35 . . . Third split ring resonator
36 . . . Fourth split ring resonator
37, 38 . . . Conductor via
51 . . . First auxiliary conductor
51*a* . . . First connection portion
51*b* . . . First capacitance formation portion
52 . . . Second auxiliary conductor
52*a* . . . Second connection portion
52*b* . . . Second capacitance formation portion
60 . . . Wireless communication device
61 . . . Multilayer printed circuit board
62 . . . First antenna
63 . . . Second antenna

The invention claimed is:

1. An antenna comprising a first conductor plane in which a first split ring resonator and a second split ring resonator are formed and a feed line including a first branch line, a second branch line and a branch portion, wherein the first split ring resonator comprises a first conductor region along an opening edge of a first opening formed in the first conductor plane and a first split portion cutting through a portion of the first conductor region;

the second split ring resonator comprises a second conductor region along an opening edge of a second opening formed in the first conductor plane and a second split portion cutting through a portion of the second conductor region;

one end of the first branch line is connected to the first split ring resonator and the other end extends to the branch portion across the first conductor region; and one end of the second branch line is connected to the second split ring resonator and the other end extends to the branch portion across the second conductor region.

2. The antenna according to claim 1, wherein the first split ring resonator is configured to have a first resonant frequency and the second split ring resonator is configured to have a second resonant frequency.

3. The antenna according to claim 1, wherein the first conductor plane includes a linear side formed at least in a portion of a periphery of the first conductor plane; and the first split portion and the second split portion are formed on the linear side of the first conductor plane.

4. The antenna according to claim 3, wherein the connection point between the first branch line and the first split ring resonator is located closer to the second split ring resonator with respect to the first split portion; and the connection point between the second branch line and the second split ring resonator is located closer to the first split ring resonator with respect to the second split portion.

5. The antenna according to claim 3, wherein the connection point between the first branch line and the first split ring resonator is located farther from the second split ring resonator with respect to the first split portion; and the connection point between the second branch line and the second split ring resonator is located farther from the first split ring resonator with respect to the second split portion.

6. The antenna according to claim 1, wherein the first conductor plane further comprises a clearance communicating with the first opening and the second opening; and the feed line is disposed in the same plane as the first conductor plane and extends inside the clearance while keeping a predetermined distance to both sides of the clearance.

7. The antenna according to claim 1, wherein the feed line is formed extending in a plane that is different from the first conductor plane and faces the first conductor plane.

8. The antenna according to claim 1, further comprising a second conductor plane different from the first conductor plane, the second conductor plane facing the first conductor plane, wherein a third split ring resonator and a fourth split ring resonator are provided in the second conductor plane;

the first split ring resonator is connected to the third split ring resonator at a plurality of positions spaced at predetermined intervals in a circumferential direction; and the second split ring resonator is connected to the fourth split ring resonator at a plurality of positions spaced at predetermined intervals in a circumferential direction.

9. The antenna according to claim 1, wherein at least one of a first auxiliary conductor and a second auxiliary conductor is disposed in a plane that is different from the first conductor plane and faces the first conductor plane;

the first auxiliary conductor comprises a first connection portion connected to one end of the first conductor region cut by the first split portion and a first capacitance formation portion facing the other end of the first conductor region and forming a capacitance; and the second auxiliary conductor comprises a second connection portion connected to one end of the second conductor region cut by the second split portion and a second capacitance formation portion facing the other end of the second conductor region and forming a capacitance.

10. A wireless communication device using electromagnetic waves including two or more frequencies to transmit and receive wireless signals, the wireless communication device comprising a first conductor plane in which a first split ring resonator and a second split ring resonator are formed and a feed line including a first branch line, a second branch line and a branch portion, wherein the first split ring resonator comprises a first conductor region along an opening edge of a first opening formed in the first conductor plane and a first split portion cutting through a portion of the first conductor region;

the second split ring resonator comprises a second conductor region along an opening edge of a second opening formed in the first conductor plane and a second split portion cutting through a portion of the second conductor region;

one end of the first branch line is connected to the first split ring resonator and the other end extends to the branch portion across the first conductor region; and one end of the second branch line is connected to the second split ring resonator and the other end extends to the branch portion across the second conductor region.

* * * * *